US006997765B1

(12) United States Patent
McGuinness

(10) Patent No.: US 6,997,765 B1
(45) Date of Patent: Feb. 14, 2006

(54) VESSEL PROPELLED BY OSCILLATING FIN WITH CONTROL MECHANISMS

(76) Inventor: Thomas G. McGuinness, 1779 Moody La., Geyserville, CA (US) 95441

( * ) Notice: Subject to any disclaimer, the term of this patent is extended or adjusted under 35 U.S.C. 154(b) by 0 days.

(21) Appl. No.: 10/845,910

(22) Filed: May 14, 2004

Related U.S. Application Data

(60) Provisional application No. 60/470,954, filed on May 14, 2003.

(51) Int. Cl.
*B63H 1/36* (2006.01)

(52) U.S. Cl. ..... 440/14; 440/21; 440/32

(58) Field of Classification Search ..... 440/13, 440/14, 15, 21, 26, 32, 56
See application file for complete search history.

(56) References Cited

U.S. PATENT DOCUMENTS 871,059 A * 11/1907 Douse ..... 416/81
2,241,305 A * 5/1941 Hill, Jr. ..... 440/15
2,696,797 A * 12/1954 Whidden ..... 440/14
3,915,417 A * 10/1975 Norton et al. ..... 248/584
4,345,903 A * 8/1982 Laser ..... 440/14
4,977,847 A * 12/1990 Bartlett ..... 114/274
5,000,706 A 3/1991 Wang
5,021,015 A 6/1991 Wang
5,401,196 A 3/1995 Triantafyllou
5,740,750 A 4/1998 Triantafyllou
5,997,369 A 12/1999 Triantafyllou
6,138,604 A 10/2000 Anderson
6,193,466 B1 2/2001 Earl
6,375,530 B1 4/2002 Earl
6,558,210 B1 5/2003 Frasier
6,835,108 B1 12/2004 Gieseke

* cited by examiner

*Primary Examiner*—Stephen Avila

(57) ABSTRACT

A marine propulsion system emulates the fishes swimming motion yet is highly maneuverable as it permits changes from forward to reverse motion while underway. In other aspects, the propulsion system may be designed and optimized for efficient human powered propulsion.

16 Claims, 15 Drawing Sheets

FIG. 7C
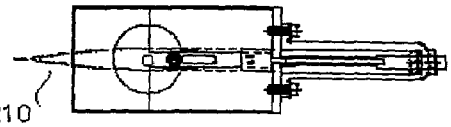
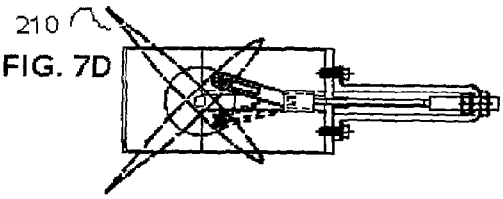
FIG. 7D
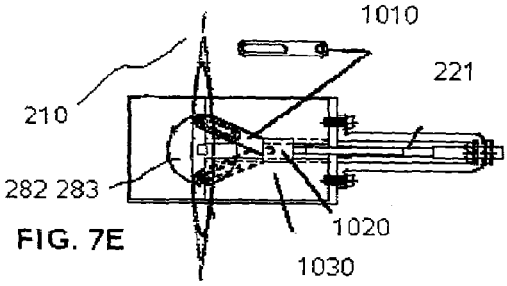
FIG. 7E
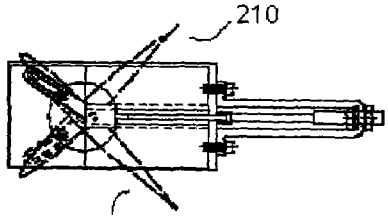
FIG.7F
FIG. 7A
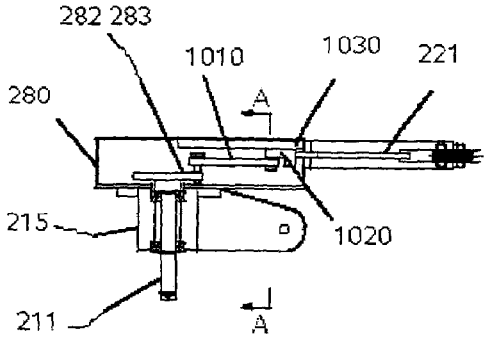
FIG. 7B
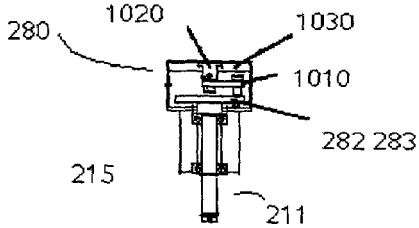
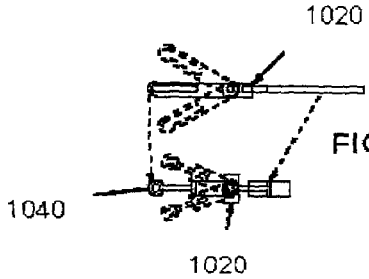
FIG. 7G FIG. 8A
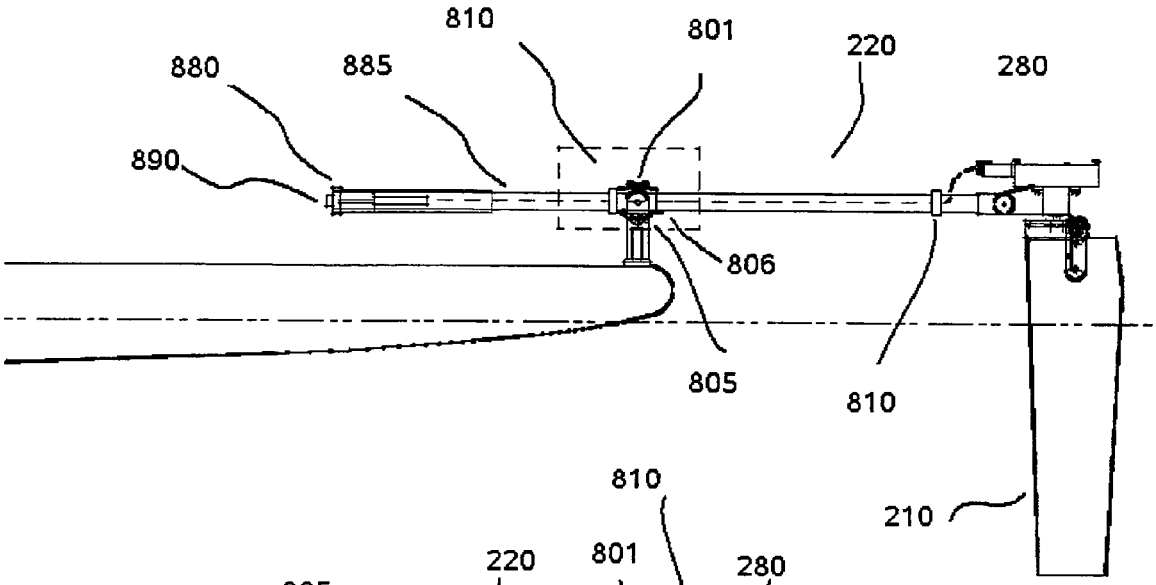
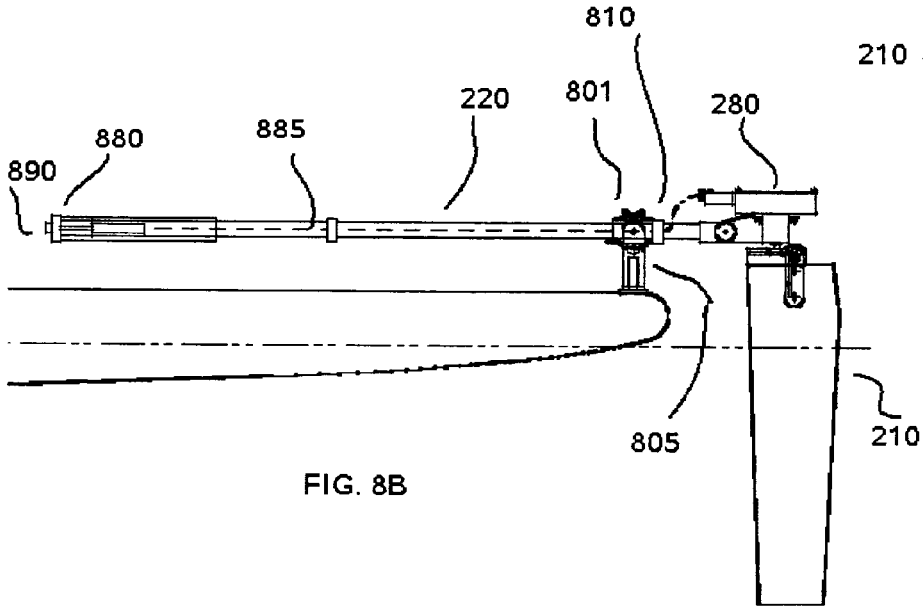
FIG. 8B

VESSEL PROPELLED BY OSCILLATING FIN WITH CONTROL MECHANISMS

CROSS REFERENCE TO RELATED APPLICATIONS

This application claim priority to U.S. provisional patent application entitled "VESSEL PROPELLED BY OSCILLATING FIN WITH CONTROL MECHANISMS", filed May 14, 2003 and having Ser. No. 60/470,954, which is incorporated herein by reference.

BACKGROUND OF INVENTION

The present invention relates to marine propulsion systems and methods, more specifically to a marine propulsion system that is highly efficient, in part, through emulation of a fishes swimming motion.

U.S. Pat. No. 5,000,706 to Wang having issued on Mar. 19, 1991 teaches a rocker arm type propulsion mechanism for a personal water craft type boat which emulates some aspects of a fishes swimming motion. However, Wang's mechanical assembly is complex and inconvenient in the manner in which it controls thrust magnitude and direction. Further, the boat lacks efficient means for steering, dynamic stabilization and control and other practical requirements of watercraft handling.

It is therefore a first object of the present invention to provide an improved marine propulsion system for personal watercraft. The propulsion system is scalable up or down in size for use in larger or smaller vessels, respectively.

It is therefore a second object of the present invention to provide a marine propulsion system having improved propulsion efficiency and reliability using a fewer number of moving parts and incorporating features to resist damage and fouling.

Another object of the invention is to provide an improved and versatile maneuvering system for marine propulsion systems.

Yet another object of the invention is to provide for personal watercraft that is human powered, highly maneuverable and resistant to damage and fouling upon collision with submerged obstructions, floating debris, or grounding/beaching. The propulsion and maneuvering system does not require the use of a hand-held paddle or oar for steering, braking, reverse thrust, launching or docking or other normal maneuvering operations.

SUMMARY OF INVENTION

In the present invention, the first object is achieved by providing an efficient marine propulsion system herein disclosed which is capable of generating forward and reverse thrust by approximating the swimming motion of a class of marine animals known as thunniform swimmers. Thunniform swimmers generate thrust by causing an airfoil shaped fin to heave side to side in a periodic manner, while said fin is allowed to pivot in a coordinated manner about the attachment point between the propulsion fin and the portion of the animal's body ahead of the fin causing the heaving motion. This coordinated heaving and pivoting motion produces a favorable angle of attack between the fin and fluid thereby generating a hydrodynamic lift force. The component of the lift force parallel to the direction of swimming provides thrust to overcome drag forces acting in the opposite direction of the animal's forward motion through the water.

In contrast to marine animals, another aspect of the present invention is a method and apparatus to generate the heaving and pivoting motion. This apparatus is not submerged and may be located above the surface of the water, with only the airfoil section of the propulsion fin immersed in the fluid. The propulsion system generates thrust using the principle of lift generated by an airfoil shaped fin of finite span moving through a fluid at some relative velocity and angle of attack. In common with marine animals, and in addition to the hydrodynamic lift generated by the airfoil, the periodic heaving and pitching movement of the airfoil generates a vortex wake structure known as a "reverse Karman street", whereby the opposing direction of rotation of the alternating vortices is though to create a "jet" of higher velocity water between them along the wake longitudinal centerline, thereby improving the propulsive efficiency. It is also thought that reversal of circulation around the fin upon heave-cycle reversal is enhanced by close proximity to the unbound vorticity from the previous heave half-cycle. Propulsion efficiency can therefore be enhanced by operating the propulsion system in a manner that exploits the existence of these wake vortices.

The wake characteristics of the reverse Karman street are usually expressed in terms of the dimensionless Strouhal Number ($St=fA/U$), where f=tailbeat frequency (Hz), A=peak-to-peak amplitude of the propulsion fin's heaving motion, and U=the boat forward velocity. Triantafyllou et al in U.S. Pat. No. 5,401,196 issued Mar. 28, 1995, which is incorporated herein by reference, have identified that for a variety of fully submerged marine animals swimming at high speeds, optimum propulsion efficiency occurs in the region $0.25<St<0.40$. The present invention is capable of operating at a wide range of Strouhal Numbers, including the range identified by Triantafyllou et al.

The propulsion system generates forward and reverse thrust, the magnitude of which is continuously adjustable while underway. The full range of thrust is controllable by a single linear actuator acting upon a sliding yoke. The propulsion system generates heaving motion by means of at least one tail arm boom sweeping side to side above the surface of the water, each boom pivoted about a fixed location on the hull.

In yet another aspect of the invention the propulsion system is capable of using human power, photoelectric power, stored electric power, internal combustion engine power, gas turbine power, steam turbine power, steam engine power, power, electric motor power, or any useful combination thereof. The propulsion system employs variable geometry to facilitate efficient utilization of the available power over the full range of design hull speeds, pedaling frequency, heaving amplitude and fin geometry. For human powered applications, the power input will normally vary anywhere between 0 and 500 watts for cruising, but may reach or exceed 1,000 watts during short-duration sprints. Depending on hull design, boat speeds in excess of 6 miles per hour should be attainable. Maximum vessel speed is generally a function of hull resistance and available power input, and is not inherently limited by any aspect of the propulsion system design concept.

In yet another aspect of the invention, the propulsion system optionally employs tunable energy storage devices for efficient torque/displacement matching of the operator/driver and the rest of the propulsion system. The propulsion system can be configured to exploit the energy storage and resonance characteristics of its torsional pendulum configuration. It is possible to tune the torsional natural frequency of the system for beneficial purposes by changing spring stiffness and/or changing the location of a tuning mass along the tail arm boom. Mass may also be added to, or the location of the mass adjusted on a forward extension of the clevis, which will provide improved static and dynamic balance. Mass may also be added or removed from the pylon crank arm.

Thus, as will be further disclosed, for human-powered applications, the propulsion system exploits the ergonomic advantages and energy potential of the recumbent pedaling position.

Yet a further aspect of the invention is characterized in that a maneuvering and dynamic stabilization system is provided which is capable of providing steering, braking, stabilization of roll/yaw oscillations, and obstacle/debris clearance functions, and which may be controlled by a human operator and/or microprocessor based control system. The maneuvering system exploits the ergonomic benefits and simplicity of a single control handle and single throttle control, facilitating human coordination between and sequencing of propulsion, maneuvering, retraction and throttle actions. The maneuvering system is hydrodynamically and statically balanced, and throttle position automatically maintained in set position, thereby enabling hands-free operation, if desired.

The above and other objects, effects, features, and advantages of the present invention will become more apparent from the following description of the embodiments thereof taken in conjunction with the accompanying drawings.

BRIEF DESCRIPTION OF DRAWINGS

FIG. 5A is a elevation of the rudder fins and maneuvering system from the pylon looking aft end whereas

FIG. 7A is an elevation of an alternative transmission mechanism.

FIG. 7B is an elevation view of the transmission of FIG. 7A taken at section A–A'.

FIGS. 7C, D, E, and F are plan views showing the operation of the transmission with respect to the alternative positions of the propulsion fin for tiller, forward thrust, neutral and reverse thrust operation respectively.

FIG. 7G is a detailed view of the alternative position of the crosshead components in FIG. 7E.

DETAILED DESCRIPTION

Figure 1A:
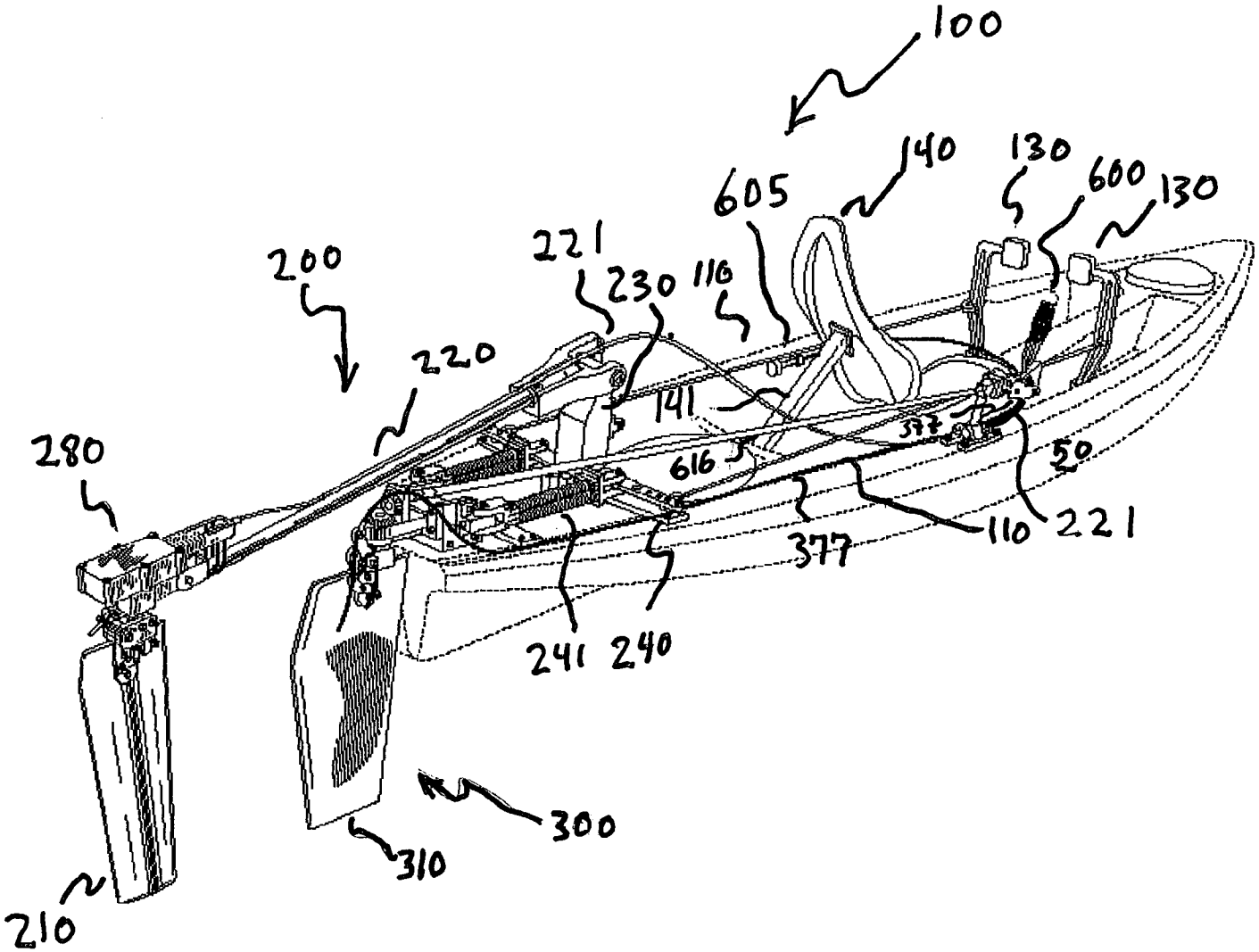
FIG. 1A is a perspective illustration of a first embodiment of a tailboat illustrating the primary propulsion and steering fins.

Referring to FIGS. 1 through 10, wherein like reference numerals refer to like components in the various views, there is illustrated therein a new and improved vessel propelled by oscillating fin with control mechanisms, generally denominated 100 herein.

FIG. 1 illustrates a preferred embodiment of the invention where boat hull 50 is propelled by a aftmounted marine propulsion system 200 driven by a person seated in operators seat 140 using pedal cranks 130 to drive the pivoting motion of the tail arm boom 220, and ultimately propulsion fin 210. The human operator, sitting in seat 140 steers with maneuvering mechanism 300, which is controlled by control handle 600, which is located ahead and to the right (starboard) of the operators seat. The pedal cranks 130 drive the reciprocal motion of drive cables 110 which are attached at the distal end to horizontal port and starboard crank arms 240 extending from the tail arm boom support pylon 230, causing the pivoting movement of tailboom 220 and propulsion fin 210, which along with rudder fin 310, is partially submerged in the water. Support pylon 230 is disposed within the vertical bore of baseplate 201, which is mounted to the vessel hull.

As will be further described with a more detailed description of the propulsion systems subsystems, control system 600 comprises a joystick style handle in which the movement thereof in orthogonal planes causes steering, through steering control shaft 616, as well as retraction of the rudder fin 310 via retraction cable 377. Handle 610 is located on the opposite side of the cockpit or seat area from control knob 606. Linear retraction cable 377 descends from the bottom of handle 610 aftward, having a proximal end connect to control knob 606 and having the distal end connected to transmission housing 280 located above propulsion fin 210. Although this preferred embodiment also deploys a leeboard comparable to that labeled as 150 in FIG. 1B, it is not illustrated in FIG. 1A for simplicity. Such a leeboard may be placed on either or both the port or starboard side of the vessel, as well as a amidships descending from the bottom of the vessel on the centerline thereof.

System of Coordinates

Figure 1B:
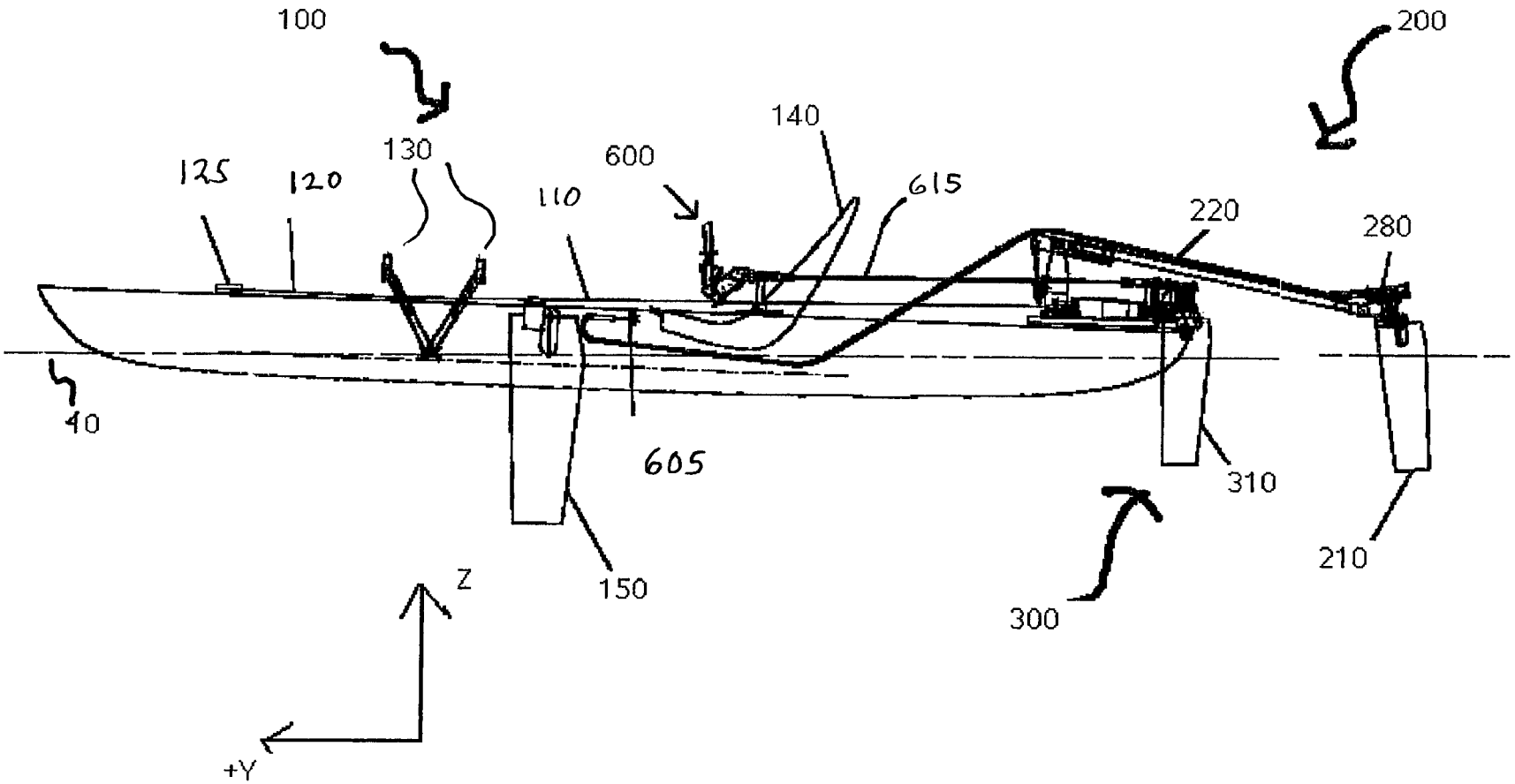
FIG. 1B is an elevation of a second embodiment of a tailboat illustrating the primary propulsion and steering fins.

In accordance with the present invention, the system of coordinate is designated with respect to FIG. 1B showing a vessel 100 in elevation in the water through the y-axis, which runs along the longitudinal centerline of the boat, in the horizontal plane. The horizontal line 10 indicates the nominal location of the waterline when a single occupant sitting in seat 140 operates the vessel. The x-axis runs amidships and perpendicular to the longitudinal centerline of the boat, in the horizontal plane.

Figure 2A:
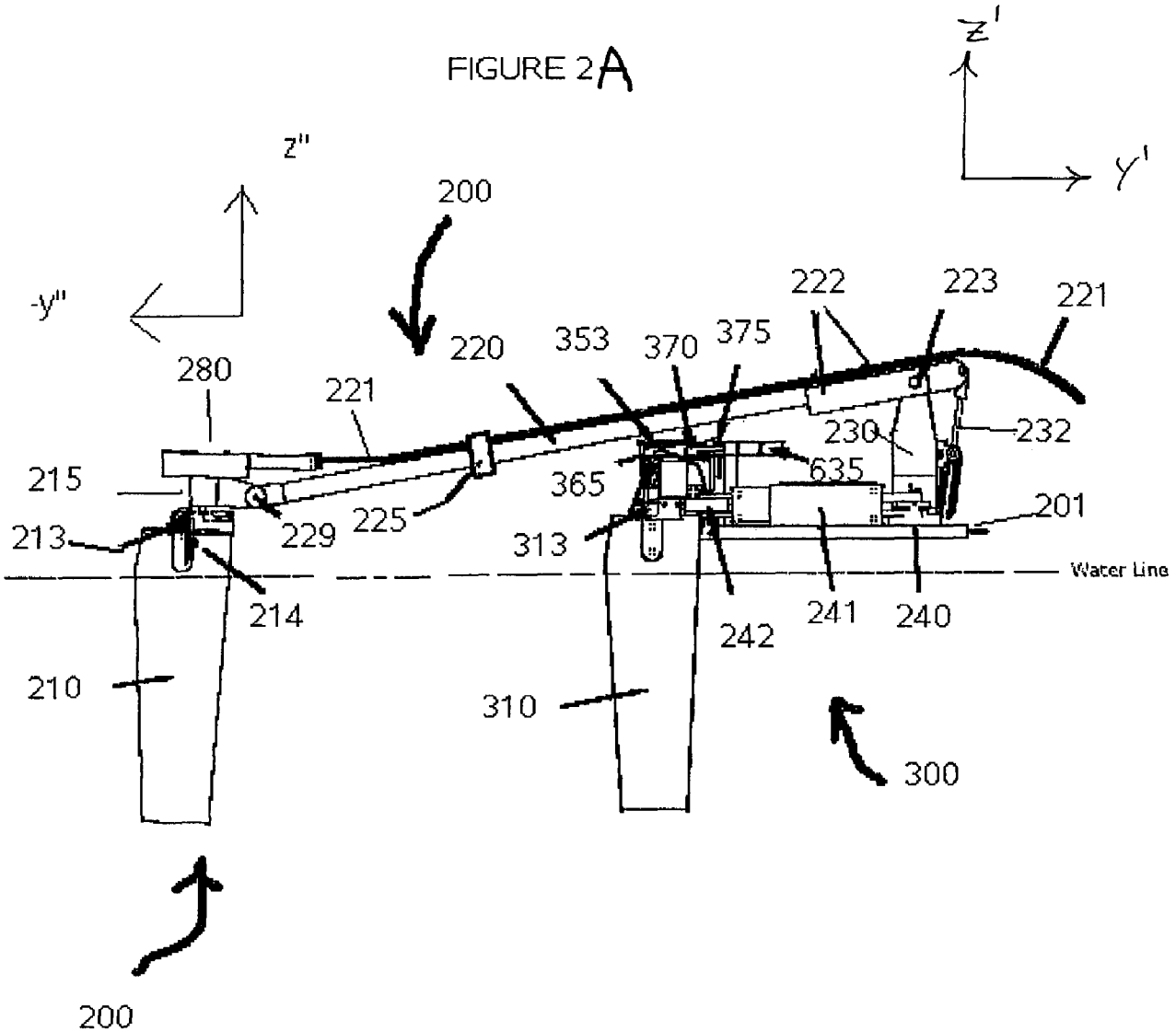
FIG. 2 is an elevation of the aft section of the tailboat of FIG. 1 showing further details of the actuators and control mechanisms coupling the propulsion power source and controls to the propulsion fin and rudder fin.
Figure 2B:
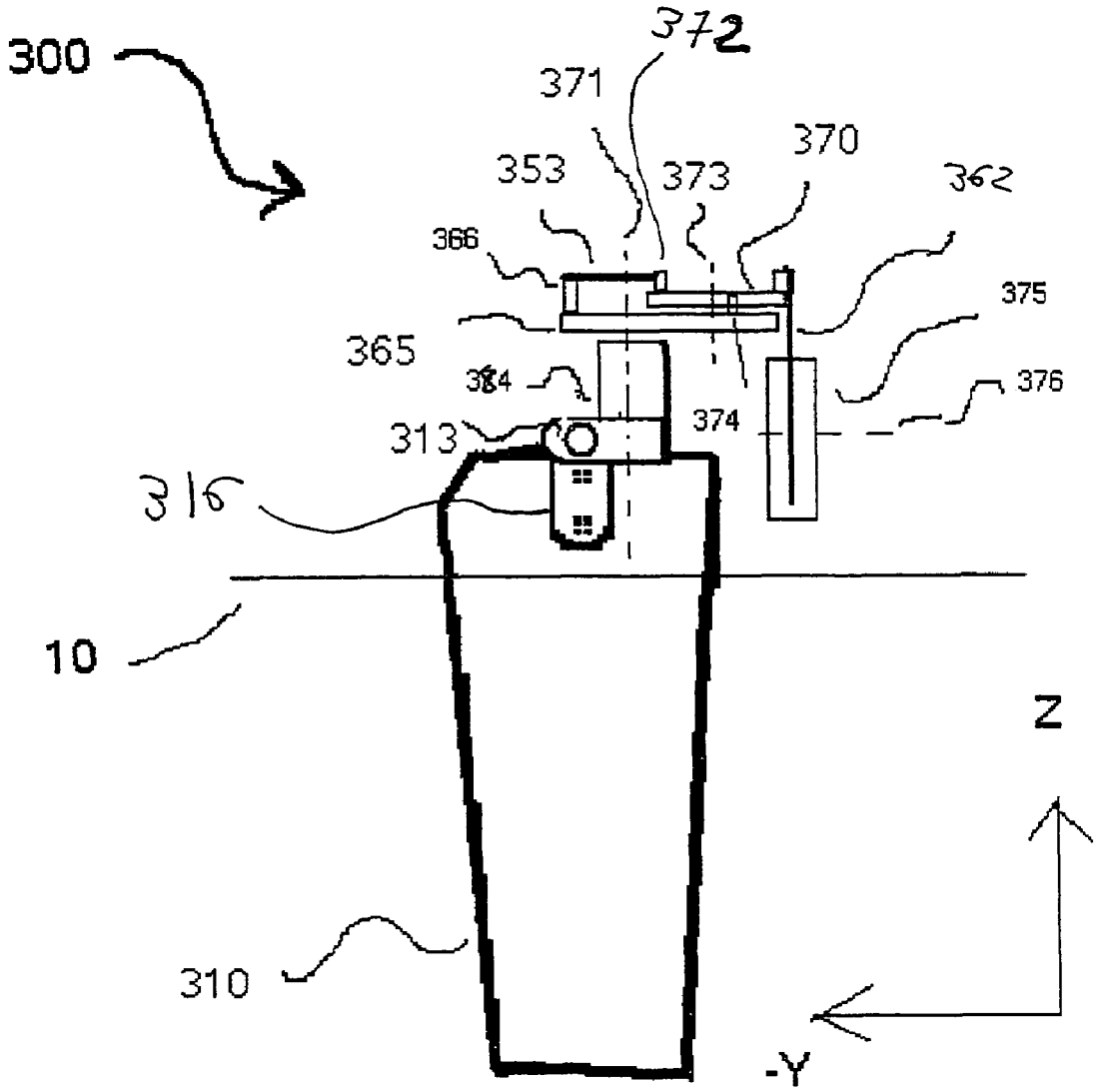

Non static axis are denoted by either a prime (') or double prime (") superscript for selected components in the propulsion system 200 and maneuvering mechanism 300 in FIG. 2 that move with respect to the fixed axis x, y and/or z. Thus, for the propulsion system 200, illustrated in further detail in FIG. 2, the y'-axis intersects the pylon support shaft (not shown) concentric with pylon 230 and is always parallel to the tail arm boom 220. The y"-axis intersects the propulsion fin support shaft and is always parallel to the propulsion fin camber line.

Likewise, the x'-axis intersects the pylon support shaft and is always perpendicular to the tail arm boom. The x"-axis intersects the propulsion fin support shaft and is always perpendicular to the propulsion fin camber line.

The z-axis runs normal the horizontal plane, through the intersection of the x- and y-axes. The z'-axis runs normal to the horizontal plane, through the intersection of the x'- and y'-axes and is always colinear with the pylon support shaft. The z"-axis is normal the x"–y" plane, and is collinear with the propulsion fin support shaft.

Main Propulsion Fin & Transmission System

The propulsion system 200 in FIG. 2 incorporates a pivoting fin 210 suspended from the outboard end of a tail arm boom 220 cantilevered over the stern of the boat 100. The tail arm boom 220 pivots side to side in a periodic sweeping motion about a fixed vertical shaft through pylon 230 on the boat. The pivoting fin 210 therefore inscribes an arc shaped path through the water with respect to the boat 100. Due to the boat's forward or reverse direction of motion through the water, the pivoting fin support shaft inscribes an approximately sinusoidal shaped path through the water. By selecting an appropriate pivot angle for the fin, a favorable range of fin angle of attack will be established between the fin and the apparent water velocity for the efficient production of hydrodynamic lift force. The fin free-stream angle of attack is the vector sum of fin heaving velocity and boat velocity, with respect to the instantaneous fin angle created by the sum of tail arm heave angle and fin pivot angle. The component of lift force parallel to the direction of boat travel provides thrust force required to propel the boat through the water. In an embodiment wherein a human effort provides, the pivoting motion of the tail arm boom is generated by reciprocating drive cables 110 in FIG. 1. The drive cables are attached to horizontal port and starboard crank arms 240 extending from the tail arm boom support pylon 230. The drive cables 110 are directly connected to pedal cranks 130 located ahead of the operator's seat 140.

Alternatively, the crank arms 240 may be attached to a 4-bar rocker linkage driven by an electric motor, steam turbine, steam engine or internal combustion engine prime mover. Numerous other means of connecting foot pedals and/or hand levers to the crank arms 240 are possible, as known in the art, in order to power the sweeping motion of the tail arm boom.

Figure 3A:
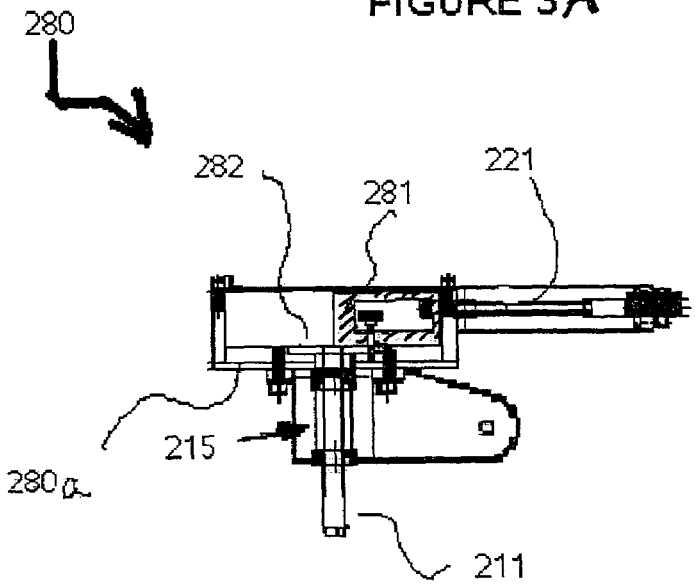
FIG. 3A is an elevation view of the transmission mechanism whereas FIGS. 3B, C, D, E and F are plan views showing the operation of the transmission with respect to the alternative positions of the propulsion fin for tiller, forward thrust, neutral and reverse thrust operation respectively.
Figure 3B:
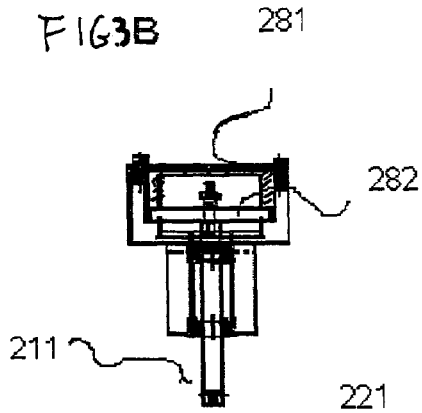
Figure 3C:
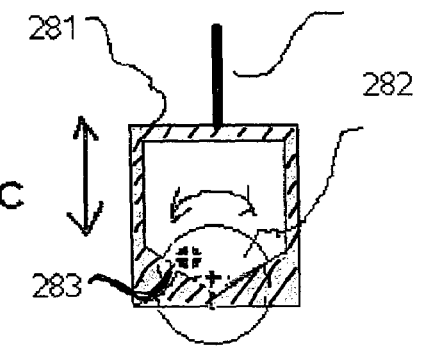

As shown in Further detail in FIG. 2, the propulsion fin 210 is attached to a hinged support clamp at hinge 213, which, as shown in FIG. 3A, is attached to a shaft 211 that is collinear with the z"-axis. The shaft 211 is supported by at least one bearing mounted in a bearing housing 215 attached to the outboard end of the tail arm boom 220 directly beneath transmission housing 280. As shown in the elevation view in FIG. 3A lever 282 is affixed to the top end of shaft 211. A pin 283 is attached to the top of the lever 282. As illustrated in plan view via FIGS. 3B, C and D the shaft 211 and lever 282 are concentric therefore able to pivot freely about the z"-axis throughout a range of motion that is variably constrained by the motion of the pin 283 that extends up between bilaterally symmetric internal contours of a yoke 281. Translation of yoke 281 within surrounding transmission housing 280 modifies the translation range of pin 283 to vary the rotation motion of fin 210 about fin support shaft 211.

In the preferred embodiment, the pivot angle remains constant for most of each half of the heaving cycle. The pivot angle of the fin automatically and symmetrically reverses upon the start of the subsequent heave half-cycle in response to the applied hydrodynamic loads. The pivot angle of the fin does not need to vary continuously.

Towards the end of each heave half-cycle, the hydrodynamic forces acting upon the fin decrease and the angle of attack may even go to zero, resulting in the fin automatically "weathervaning" or "feathering" for the remainder of the heave half-cycle. As illustrated by the yoke 281 and fin 210 position in FIG. 3E forward thrust is generated by positioning the yoke in the +y'-direction, or forward of the neutral position (shown in FIG. 3F). Alternatively, as illustrated in FIG. 3G, reverse thrust is generated by positioning the yoke in the −y'-direction, or aft of the neutral position. No thrust is generated with the yoke in the neutral position, shown in FIG. 3F.

Figure 3D:
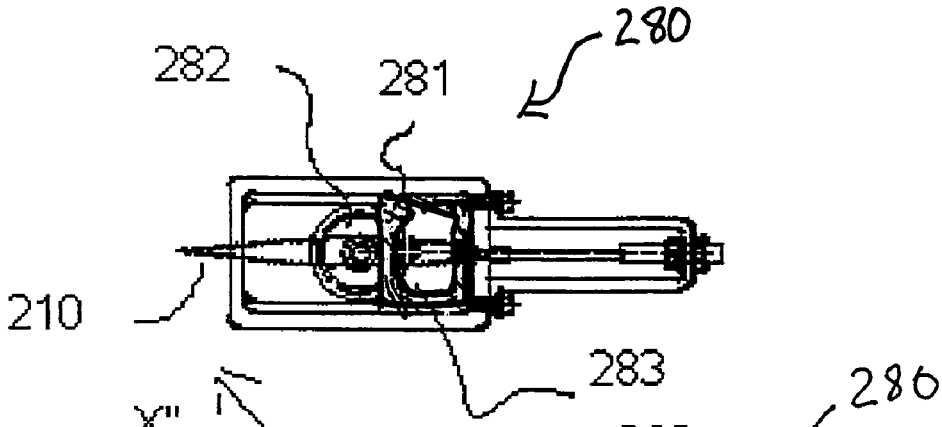
Figure 3E:
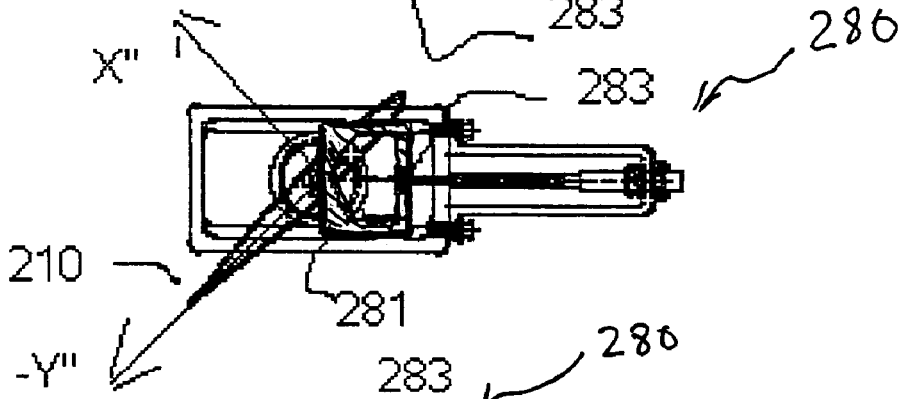
Figure 3F:
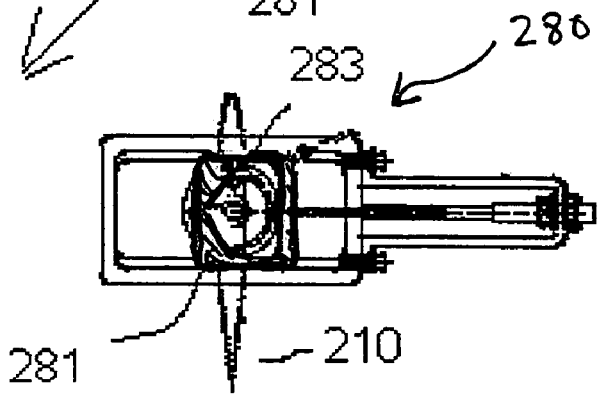
Figure 3G:
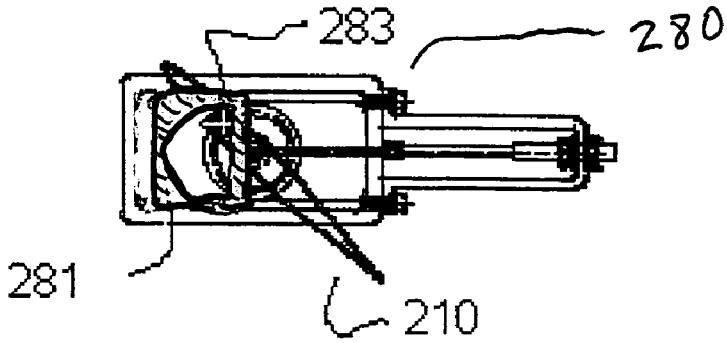

Alternatively, as shown in FIG. 3D, the tail arm 220 and propulsion fin 210 may alternatively be deployed as steering tiller by positioning the yoke at or near the maximum +y'-position to substantially limit or preclude the rotary motion of pin 283.

The yoke 281 is slideably attached to a mounting plate 280*a* that is isolated from the structural load path, preventing the effects of structural deflection on yoke position/movement and allows the use of materials with lower strength/weight. The yoke and mounting plate 280*a* may be enclosed under a protective cover housing of transmission 280. The lever 282 and pin 283 may incorporate a damping device to control impact forces and noise when the pin contacts the yoke. For lower power applications, the dampening device may be as simple as a polyurethane sleeve on the pin. For higher power applications, the pin may be mounted on a lever with spring(s) and/or viscous damper(s). The yoke actuator is equipped with a locking means, such as a lock screw, to hold the yoke in any selected position in the event of actuator failure.

Accordingly, the propulsion characteristics and direction of motion of boat 100 are continuously variable while underway as the yoke 281 can be translated within transmission 280 without interrupting the periodic sweeping motion of tail arm boom 220. Thus in one alternative embodiment a flexible control cable 221 (shown in FIG. 2 and FIG. 3A) is used to control the position of yoke 281. Cable 221 is alternatively any of either a push-pull, tension-only/spring-return, or rotary shaft, and the like types. The yoke linear actuator or control cable can be controlled manually, and/or via microprocessor and servo actuator. The internal contours of the yoke 281 are preferably bilaterally symmetric about the y'-axis, and may consist of opposing cycloidal cams, opposing v-shaped cams, opposing flat surfaces, an ellipse, or any combination thereof. Different combinations of lever radius and yoke internal contours may be chosen to minimize total yoke +/−y'-direction travel, or to minimize wear. The internal contours of the yoke may likewise consist of any contours that will result in bilaterally symmetric fin pivot angles about the z"-axis in the forward and reverse thrust directions. Fin pivot angle about the z"-axis is thereby fully adjustable to provide a suitable range of fin angle of attack for any combination of boat velocity, direction, pedaling frequency, heave amplitude and power input. Linear actuators may include, but not be limited to cables, hydraulic cylinders, electrohydraulic cylinders, power screws, solenoids, rack and pinion, cams and push rods, and air cylinders, and other actuators known in the art.

The z"-axis of rotation of fin 210 may be located anywhere between the 0% to about 40% of mean chord position, as measured from the fins leading edge, at some offset in the +y"-direction from the fins mean center of pressure (COP). In a presently preferred embodiment, the fin shaft offset from the 40% chord line is adjustable. The z"-axis offset from the fin center of pressure produces the required hydrodynamic turning moment at the beginning of each heave half-cycle, thereby enabling the fin to automatically rotate to the pivot angle for the subsequent heave half-cycle. The optimum amount of offset must be determined experimentally for each fin design. The main propulsion fin may consist of any rigid or semi-rigid symmetric airfoil shape. The prototype propulsion system utilizes an Eppler E836 airfoil shape scaled to 9.48% thickness at all sections along the span with tapered trapezoidal planform and all sections aligned at the 40% chord line.

The preferred embodiment will utilize a symmetric airfoil shape of suitable thickness consistent with material properties and construction methods. A flat fin or flexible fin capable of deflecting under load thereby producing chord wise camber may also be usefully employed. In the preferred embodiment, the planform shape of the fin varies uniformly from the root to the tip with the 40% chord line of all sections collinear.

For the construction method employed to construct working examples to date a uniformly tapered trapezoidal planform with straight leading and trailing edges was used. Other fin planform shapes, such as rectangular, triangular, elliptical or crescent (lunate) planform may also be usefully employed. From the standpoint of induced hydrodynamic drag, an elliptical planform is the most efficient shape, as is known in the art. In the current version of the working system, the planform area of the immersed portion of the fin is 108.00 in2, with an immersed span length of 18.0 inches, the immersed portion having a mean chord of 6.0 inches.

For higher boat speeds the required tailbeat frequency and input power increases. The recommended fin chord length for optimum efficiency is inversely proportional to tailbeat frequency and boat speed, i.e. for higher speeds, a shorter chord length is recommended, and visa versa. Higher aspect ratio fins provide greater propulsion efficiency regardless of tailbeat frequency or boat speed, as is known in the art. The primary determining factors limiting maximum boat speed are hull resistance and input power.

The propulsion fin may also incorporate other features known in the art such as stall fences or fin tip devices to control span wise flow across the main fin.

For pedal operated applications, the fin heaving velocity varies continuously and non-linearly from start to end of each heave half-cycle, due to the approximate slider-crank motion of the human leg. Heaving velocity is generally maximum during the beginning of the half-cycle, and steadily decreases to zero at the end of the half-cycle as the leg straightens. The heaving displacement and velocity characteristic may be modified by connecting the drive cables to pedal cranks and/or pylon cranks via cammed sheaves of any suitable profile. Though the fin pivot angle remains constant for each heave half-cycle, the instantaneous angle of attack varies continuously over each half-cycle. During prototype testing, it was discovered that important tactile feedback was provided by "pedal feel". The pedal feel can be described as "mushy" when the angle of attack is too high causing the propulsion fin to stall. Pedal feel immediately firms up once pivot angle and/or pedal force is adjusted to break the stall. Stall is also accompanied by an audible increase in noise due to flow separation on the propulsion fin and turbulence. Stall recovery is accompanied by an audible decrease in noise. During normal operation, there is very little noise generated. With a few minutes practice, the operator will learn to recognize whether or not the fin is stalling and make the necessary real-time adjustment to pedal pressure, pedal cadence rate or fin pivot angle. Pivot angle adjustment can be accomplished by fingertip pressure turning the control knob and is analogous to trimming the sail on a sailboat.

The propulsion system may be operated at any useful tail beat frequency, heave amplitude and boat speed. The range of propulsion system operation includes, but is not limited to, Strouhal Numbers in the range of $0.25<St<0.40$. The propulsion system throttle and/or transmission may be controlled in such a manner as to provide continuous variation in pivot angle during each heave half cycle, as known in the art. The prototype was found to cruise efficiently at 4.0 to 4.2 mph, with a pedaling cadence of approximately 60 cpm and maximum heave amplitude of 28.4 inches for an overall Strouhal Number of approximately 0.35 to 0.38.

The fin support hinge 213 allows rotation about a shaft parallel to the x"-axis. The fin is thereby allowed to pivot backwards about hinged joint 213 in the event of contact between the leading edge of the fin and a submerged object. Following contact with a submerged object, the fin will automatically return to its original position via spring force provided by torsion spring 214. The design of the fin support hinge allows only backwards fin rotation about the hinge shaft. Thus, forward rotation is readily prevented by the mechanical stop.

The bearing housing is attached to the tail arm boom by another hinged joint 229, shown in FIG. 2. This hinged joint 229 permits angular adjustment of the fin's z"-axis in the vertical y'–z'plane about a shaft that is parallel to the pylon's x'-axis. The "sweep angle" of the fin's z"-axis can be adjusted approx +/–30 degrees from the vertical. Yoke and bearing housing can be fabricated from any suitable material, such as aluminum, wood, plastic, or plastic matrix composite. The transmission 280 is mounted directly atop the bearing housing 215. Fin shaft 211 (in FIG. 3A) z"-position is restrained by at least one rolling element bearing, or plain bearing with thrust face and washer associated with bearing housing 215. For higher power applications, hydrostatic bearings may be used. Angular alignment of fin camber line to the centerline of the lever and pin can be adjusted by a clamp-type friction joint between the z"-axis shaft and fin support hinge. Fin support hinge is secured to z"-axis shaft via redundant means, such as retaining ring and cotter pin.

In an alternative embodiment, shown in FIG. 7, the propulsion fin is attached to a hinged support clamp 213, which is attached to a shaft 211. This shaft is collinear with the z"-axis. The shaft is supported by at least one bearing mounted in a bearing housing 215 attached to the outboard end of the tail arm boom. A lever 282 is affixed to the top end of this shaft. A pin 283 is attached to the top of the lever. The shaft, lever and pin are therefore able to pivot freely about the z"-axis within the allowable extension limits of a pivoting slotted link 1010.

The pivot point of the slotted link 1010 is attached to a rod or crosshead 1020 which can be selectively positioned in the +/–y'-axis direction by a linear actuator. The motion of the +/–y'-axis motion of the rod or crosshead is thereby capable of adjusting the fin pivot angle across the full range of thrust, from full reverse to full forward thrust, while the vessel is underway, by a single linear actuator without need for any secondary mechanism to be engaged between reverse and forward thrust. The rod or crosshead 1020 is slideably attached to and laterally constrained by a linear bearing or crosshead guide 1030 which absorb the lateral loads transmitted to the rod or crosshead 1020 by the slotted link 1010. The pivot angle is controlled by a linear actuator or flexible control cable, which positions the rod or crosshead 1020 in the +/−y'-direction from its center, or neutral, position. Linear actuators may include, but not be limited to cables, hydraulic cylinders, electrohydraulic cylinders, power screws, solenoids, rack and pinion, cams and push rods, and air cylinders, and other actuators known in the art.

Other embodiments may be possible utilizing the principle of maintaining a vertical clearance between the lower surface of the pivot angle constraining element (e.g. yoke 281, slotted link 1010) and the upper surface of the lever 282 throughout the full range of forward, reverse and neutral thrust, while only pin 283 extends above the lower surface of said pivot angle constraining element.

Alternatively, say, for higher powered applications, the slotted link 1010 can be replaced by a double-acting air or hydraulic cylinder 1040 incorporating a viscous damper at the cylinders extension and retraction limits, which serves to cushion impact loads imposed by heavier fins.

The main propulsion fin 210, as well as other fins, may be constructed of any suitable materials. The preferred embodiment for human powered and other low-power applications utilizes a carbon fiber epoxy laminate and/or Kevlar epoxy laminate over a foam core.

Propulsion Fin Pivot Angle Control System

In a preferred embodiment the propulsion system incorporates various methods to select and control pivot angle of the main propulsion fin. The propulsion fin is attached to a hinged support clamp, which is attached to a shaft. This shaft is collinear with the z"-axis. The shaft is supported by at least one bearing mounted in a bearing housing attached to the outboard end of the tail arm boom. A lever is affixed to the top end of this shaft. A pin is attached to the top of the lever. The shaft, lever and pin are therefore able to pivot freely about the z"-axis within the allowable extension limits of a pivoting slotted link. The pivot point of the slotted link is attached to a crosshead which can be selectively positioned in the +/−y'-axis direction by a linear actuator. The motion of the +/−y'fin according to the alternative positions previously described and illustrated in FIG. 3. In a non-limiting example of achieving the alternative fin positions shown in FIG. 3 the output end of a flexible push-pull cable is connected to the sliding yoke. Thus, as shown in further detail in FIG. 6B, the input end of this cable is attached to a control knob 606 with a vernier for fine control and a push-button override 607 for coarse control. The control knob is preferably supported by a quick-release mount 608 on the opposite side of the cockpit from the steering/braking/retraction system control handle 600, thereby facilitating human coordination of system thrust with the other control functions.

The yoke control cable is routed to a manual control station near the operators seat, and located on the opposite side of the boat from the control handle assembly, though it could alternatively be mounted on the same side. The preferred embodiment provides independent manual means for fine and coarse control of yoke position, such as a vernier knob with override button, respectively. Visual and tactile feedback is provided for neutral, forward, and reverse positions. Visual indication is provided for measuring the amount of yoke travel in the +/−y'-directions.

In the prototype, the manual throttle control assembly can be disconnected from the boat via a single fastener, to allow easy removal together with the tailarm boom and main propulsion fin assembly for separate storage.

The yoke control system may alternatively incorporate a servo actuator and microprocessor, with or without a manual coarse/fine control override capability.

Propulsion Heave Motion Generation System

The tail arm 220 is attached to a tail arm adapter 222, which in turn is attached to a vertically oriented pylon 230 by means of a clevis joint 223. The pylon 230 rotates about the z'-axis on a stationary vertical shaft on at least one bearing. The pylon-on-stationary-shaft approach is preferred, as it requires the smallest diameter bearing & shaft while allowing the greater section modulus of the pylon to transmit the maximum amount of torque with minimum torsional deflection and stress. For higher power applications, the pylon support bearings system may include hydrostatic bearings, which may be more reliable in applications where high loads, partial arc rotation and low rotational speeds are involved. Hydrostatic bearings also allow lubricating oil to be delivered across the pylon support bearings and on to the fin support bearings, thereby avoiding use of a hose or swivel joint, which are prone to failure.

Fin heaving motion in the +/−x-direction is generated by a tail arm boom 220, or rocker arm, rotating about a stationary shaft at the pylons z-axis in alternating directions above the water surface as a result of the operators pedaling motion. The heaving motion of the tail arm moves the main propulsion fins z"-axis of rotation along a circular arc of fixed radius, with respect to the pylon z'-axis of rotation. The heaving motion of the main fin's z"-axis traces an approximately sinusoidal path through the water at all non-zero boat speeds. This waveform is not a simple sinusoid, but is the result of the non-linear displacement and velocity characteristics of pedaling acting through the mechanical geometry of the propulsion system.

Figure 4:
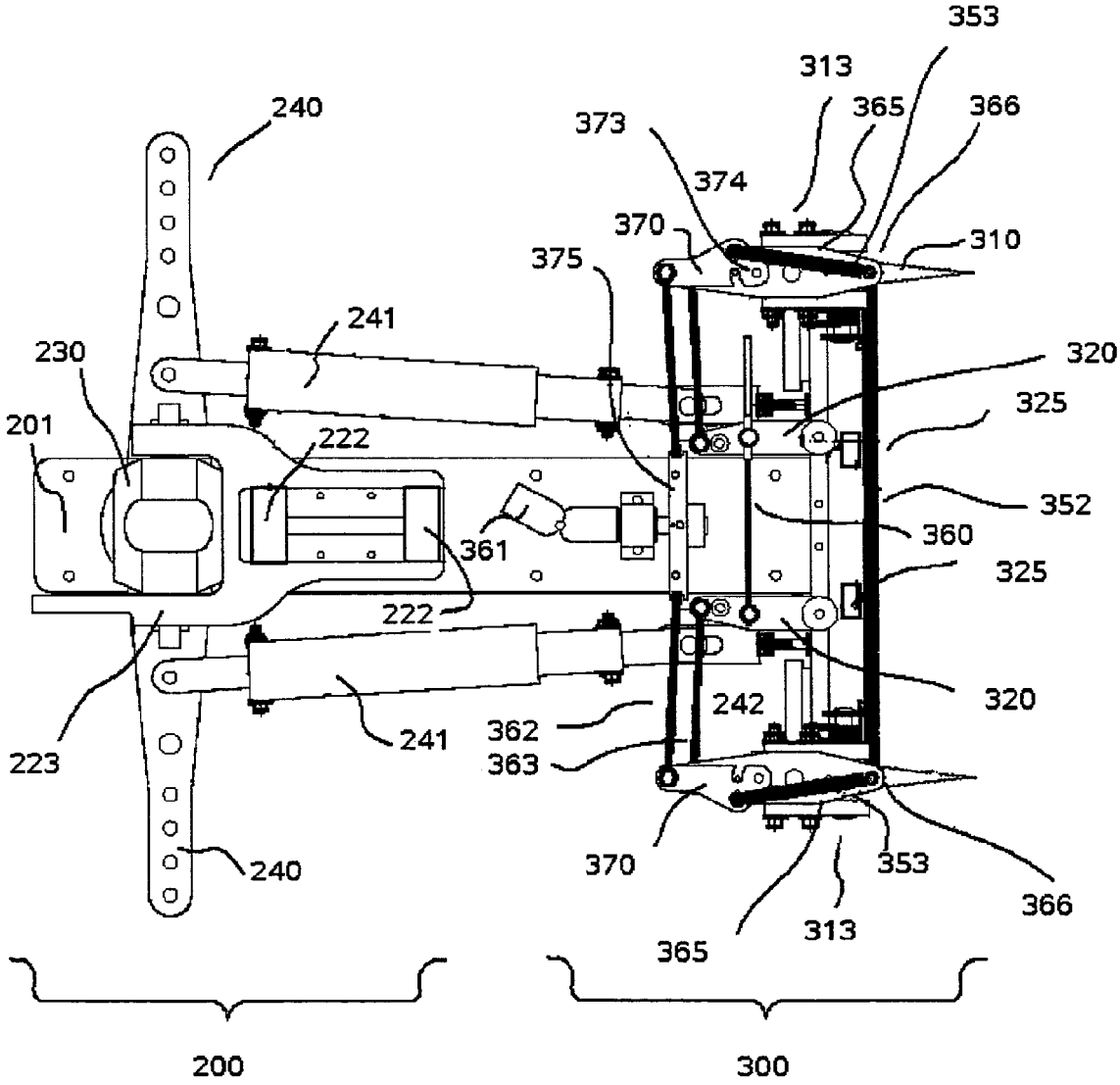
FIG. 4 is a plan view of a portion of the propulsion and maneuvering system

As shown in the plan view in FIG. 4 a horizontal crank arm 240 is parallel to the x'-axis is attached to the pylon 230 for the purpose of converting the reciprocating motion and forces of the port and starboard drive cables 110 into rotary motion and torque about the pylon's z'-axis. The crank arm can be a simple straight arm. The port and starboard drive cables are attached towards the outer ends of the crank arm 240 at equal radii from the z'-axis. Crank arms may incorporate segments of an arc or cam providing either constant or non-constant crank radius, thereby modifying the shape of the fins sinusoidal path through the water. Maximum +/− heaving angle about the z'-axis, as measured from the boats y-centerline, is readily limited by adjustable or fixed mechanical stops, which limit maximum spring extension/compression displacement to help control power transfer spring fatigue life, and limit travel in event of an asymmetric spring failure. These mechanical stops may be so located to limit either the angular motion of the pylon/crankarm (230 and 240) about the z'axis, or the foot pedals about their respective supporting axes.

Tail arm heaving angle is controlled primarily by selecting a specific drive cable attachment radius on the pylon crank arms 240 and pedal cranks 130. Tail arm heaving angle can also be controlled by the amount of leg extension in the +/−y-direction supplied by the operator during any given stroke. The tail arm 220 and tail arm adapter 222 can pivot from −30 to 220 degrees about the clevis joint 223 in the vertical y'−z'-plane. The heaving angle about the y-axis is a key variable in determining propulsion system Strouhal Number for optimum efficiency. Strouhal Number is also a function of tailbeat frequency and boat speed. There are an infinite number of combinations of heave amplitude, tailbeat frequency and boat speed to produce a Strouhal Number in the desired 0.25<St<0.40 range. The system maximum heaving angle may be designed for a specific Strouhal Number, or may be designed to permit operation at a wide variety of Strouhal Numbers. The tail arm length, as measured from the pylon z'-axis to main fin z"-axis may be of any length providing clearance around the transom and maneuvering system so long as the required heave amplitude is achieved. For human power applications, the heave cycle frequency will normally vary anywhere between 30 and 120 cycles per minute.

The tail arm 220 can be incrementally pivoted in the vertical y'–z'-plane to control the length of fin immersed in the water and for beaching or clearing debris. The tail arm normal operating, or "at rest", angle in the y'–z'-plane can be adjusted via an adjustable length linkage 232. Tail arm boom 220 can be fabricated from wood, metallic alloy or composite laminate, e.g. Aluminum, carbon fiber epoxy laminate, carbon/Kevlar epoxy, or Kevlar epoxy laminate. The joint between tail arm boom 220 and pylon clevis 223 provides for the use of a variety boom sizes and attachment methods. Tail arm 220 can be stowed onboard by pivoting it through the vertical y'–z'-plane. Alternatively, tail arm, drive fin and throttle cable can be easily removed as a single assembly and stored separately from the boat, as deterrence to theft. Removal is accomplished by rotational output of motor or engine driver can be connected to the propulsion system by means of a 4-link rocker mechanism connecting the output shaft of the driver, or speed reduction means, and the pylon 230. Alternatively, the tail arm can be operated manually by pushing and pulling a forward extension of the tail arm boom side to side in a periodic manner. This would facilitate use of the outboard propulsion assemblies, transmission and throttle means as dual-purpose propulsion and steering system for sailboats or other small watercraft.

Propulsion Power Transfer Spring and Energy Storage System:

While the propulsion fin generates a decreasing amount of thrust towards the end of each heave half-cycle the human leg is capable of exerting a higher force the closer it gets to full extension. Accordingly, in yet another aspect of the invention the propulsion efficiency is improved by storage and transfer of energy between successive heaving half-cycles. A non-limiting example of a method and apparatus for improved by storage and transfer of energy between successive heaving half-cycles are the linear extension and/or compression springs as will now be described with respect to the plan view in FIG. 4. Thus, extension springs 241 are attached to port and starboard crank arms 240. The springs allow storage of useful energy from the latter half of each heave cycle and then release that energy during the first half of the following heave half-cycle where the energy input requirement is higher. The springs therefore provide a better match between the human leg's force characteristic and the propulsion system's thrust characteristic, thereby improving ergonomic and propulsion efficiency. Alternatively, torsion springs or hydraulic springs may be used.

In alternative embodiments counterweights, hydraulic springs, torsional springs, resonant oscillators, or other energy storage device may be used in lieu of or in combination with the energy transfer springs. The crank arms 240 are optionally designed to allow spring attachment at least one radius, to maximize energy storage for different selected heave amplitudes or spring designs. The fixed end of each spring assembly is attached to an adjustable support. The support design may include an adjusting screw 242 or other means to balance and independently adjust spring pre-tension. The port and starboard energy transfer springs may or may not be contained in their respective enclosed containment housings. Rotational inertia of the tail arm assembly about the pylon z'-axis, hence the torsional natural frequency about the z'-axis, can be controlled by changing the location of a clamp-on pendulum weight 225 in the +/−y'-direction along the tail arm boom. Mass may also be added or removed from the pylon crank arm. Mass might also be added to a forward extension of the tail arm boom, which would provide improved static balance about the clevis joint and improved dynamic balance of reciprocating forces. Torsional natural frequency of the tail arm assembly about the pylon z'-axis can also be controlled by changing the spring stiffness.

Rudder Fin Maneuvering System

Figure 5A:
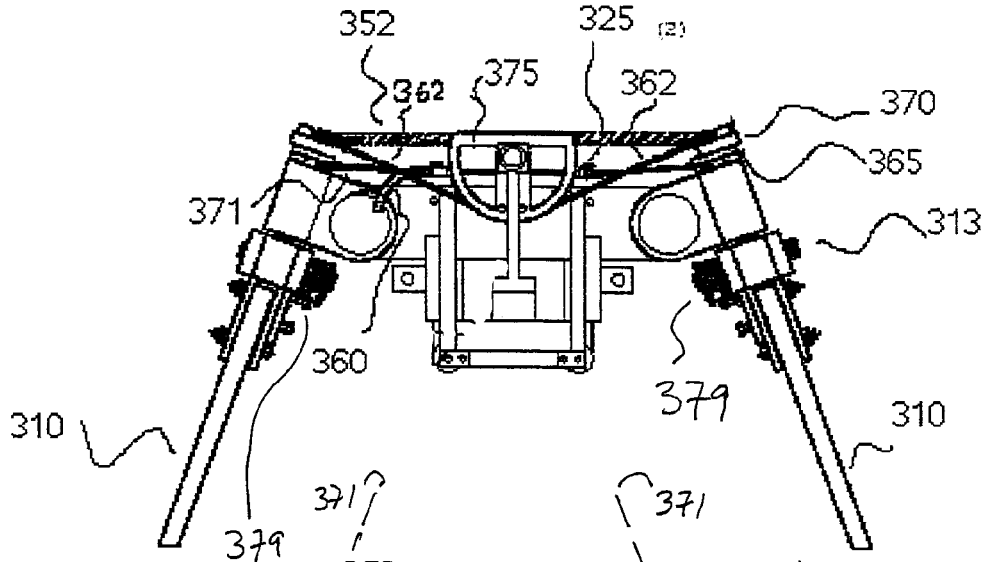
Figure 5B:
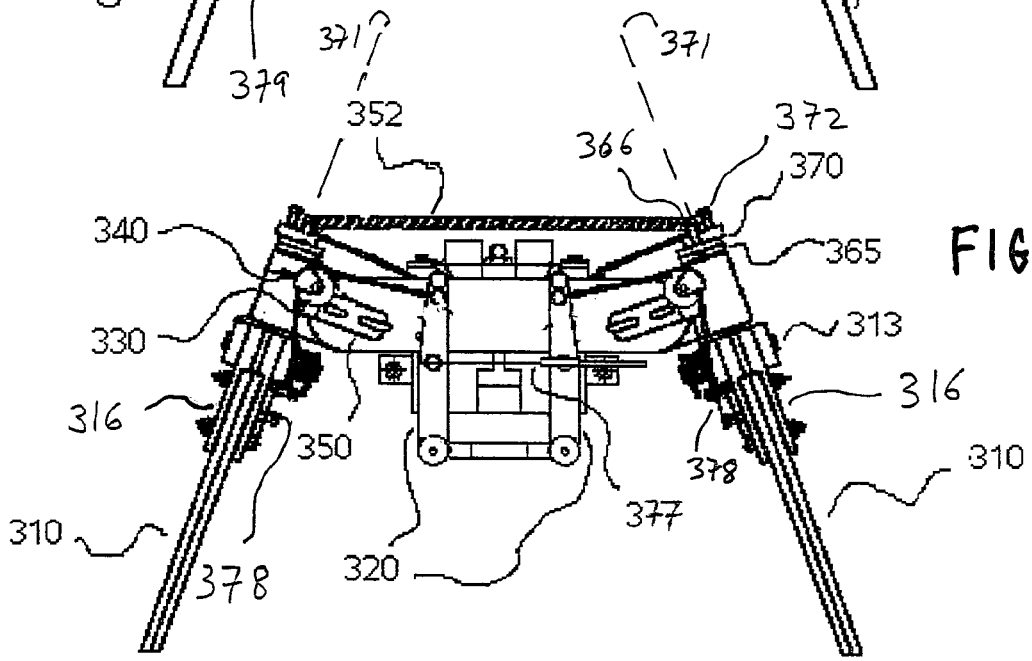
FIG. 5B is an elevation of the propulsion and maneuvering system from the aft looking forward.

As shown in the preferred embodiment in FIG. 1, a single rudder fin 310 may be deployed to steer vessel 50. An alternative embodiment of a rudder system is shown in the elevation of FIG. 5, two rudder fins 310 are located symmetrically and adjacent to the port and starboard sides of the transom for steering, symmetric braking, and balancing any unbalanced dynamic forces and couples created by the heaving propulsion fin. Two fins are provided for increased surface area for minimum drag during torque balancing, symmetric braking and reduced draft. Alternatively, a single rudder fin may be employed instead of two fins. However, a single rudder configuration would not be capable of providing symmetric braking. However, in the present invention, effective braking action is still available with the single rudder configuration. The steering shaft is connected to the rudder support shaft via right angle gears of ratio 1:1. Braking is applied by alternatingly rotating the control handle between +/−90 degrees, which in turn causes the single rudder fin to rotate between +/−90 degrees to the oncoming flow. The rudder fins are controlled by a control handle and mechanism 600 from the operator's cockpit.

Steering the boat, or yaw control, is accomplished by rotating the leading edges of the rudder fins to the left or right in tandem about the respective fin support shaft, maintaining a parallel relationship between the fins. Depending on the boat hull design, it may also be advantageous for the hull to incorporate at least one keel or leeboard for improved turning radius and to minimize sideslip in turns. The steering angle about the fin support shafts is fully controllable by the operator from −60 to 60 degrees. Symmetric braking is accomplished by rotating the leading edges of both rudder fins inwards in equal and opposite directions about their respective fin support shaft. The single drive fin generates alternating unbalanced couples about the y'- and z'-axis, which are in phase with the fin heaving motion, tending to produce a rolling and yawing motion in the hull, respectively. Pedaling motion of the legs also produces an alternating rolling moment about the y-axis. The resulting alternating yaw amplitude depends on the boats polar moment of inertia about the z-axis, the rotational hull resistance about the z-axis, and any corrective torque applied by the rudder fins, if any. During prototype testing, the yaw amplitude was typically less than +/−5 degrees about the boat's z-axis and required no steering counterbalancing for routine purposes. The resulting alternating roll amplitude depends on the boats polar moment of inertia about the y-axis, the boats metacentric height and other roll stability characteristics, and any corrective torque applied by the rudder fins. During prototype testing, roll amplitudes were minor without need for counterbalancing by the rudders.

The rudder fins 310 can be remotely retracted from the cockpit, for the purpose of beaching/transporting the boat or clearing debris. Each rudder fin is allowed to pivot backwards about its support hinge joint in the event of contact between the leading edge of the fin and a submerged object. Following contact with a submerged object, the rudder fin will automatically return to its original position by spring force. The design of the fin support hinge allows only backwards fin rotation about the hinge shaft, forward rotation from the vertical being prevented by a mechanical stop. Alternatively, without jeopardizing the novelty or utility of the present invention, the rudder fins may be supported by non-retractable non-hinged fins, with ensuing increased risk of potential collision damage and loss of the ability to beach the boat.

Rudder fin torque about the fin support shaft may be partially or fully balanced by locating the centerline of the fin support shaft at or some +y distance forward offset from the fin center of pressure. The rudder fin support shaft may be oriented vertically, or at an angle about the y-axis up to +/−30 degrees from vertical, to maintain adequate alignment between rudder bell cranks and steering cable. Rudder fins may designed to be mechanically interchangeable with the main propulsion fin, providing up to two spare fins in the event of damage to the main propulsion fin. Steering and fin retraction functions will remain upon use or loss of a single rudder fin. Steering effectiveness will be reduced by 50%. Symmetric braking function will be lost. Angular alignment of rudder fin camber line with respect to its respective bell crank centerline can be adjusted by friction joint between the fin support shaft and fin support hinge. Fin support hinge is secured to the fin support shaft with redundant means, such as retaining ring and cotter pin. The rudder fin may consist of any rigid or semi-rigid symmetric airfoil section. The preferred embodiment utilizes a thin laminar flow airfoil section. The rudder fin may be constructed of any suitable materials. The preferred embodiment utilizes a carbon fiber epoxy laminate and/or Kevlar epoxy laminate applied over a foam core.

Braking System

FIG. 6 illustrates a control mechanism 600 that operates the maneuvering system 300 comprising rudder fins 310. The control mechanism incorporates a means to apply a laterally symmetric hydrodynamic braking force to slow the boat's velocity through the water. By pivoting the leading edges of both rudder fins 310 inwards by equal amounts, the resulting hydrodynamic forces are equal and opposite, thereby slowing the boat without causing the boat to turn. Rotating the control handle 610 aftwards in the −y-direction about the x-axis causes braking lever 660 to pivot forward, thereby causing a linear actuator 360 to pull the brake calipers 325 towards each other. In the prototype, the motion of the control handle 610 applies tension to and retracts the primary brake cable 360, which is of the tension-only bicycle type. The linear braking actuator causes the forward ends of the rudder fin bell cranks 365 to rotate towards each other by substantially equal amounts about their respective z-axis in opposite directions out of their normal parallel alignment. The rudder bell cranks 365 are allowed to pivot towards each other causing the extension of redundant braking springs 353 connecting the rear ends of the two rudder bell cranks 365 to their respective tension arms 370. The linear braking actuator 360 is connected to a pair of caliper arms 325, one end of each arm being fixed and the other end connected to a secondary brake linkage or cable 363 attached to the forward end of each rudder fin bellcrank 365. As the bell cranks rotate towards each other during braking, tension in the steering cable 362 is maintained by the tension arms 370 on each bellcrank 365, via springs 353. As the primary braking actuator 360 is retracted, the caliper arms 325 are caused to pivot about the fixed end, thereby causing retraction of the secondary brake cables or linkages 363. The role of the caliper arms 325 is to two-fold; to allow a single linear braking actuator to control two rudder fins, and to prevent steering from being restrained by the braking system during normal maneuvering. In other words, the calipers 325 serve to decouple and isolate the various rudder fin control functions from each other. The braking angle is fully controllable by the operator from zero to 45 degrees about the z-axis. Upon release of the control handle 610, the rudder fins 310 automatically return to their normal parallel alignment by means of the braking springs connecting the aft ends of each rudder fin bell crank. Alternatively, without jeopardizing the utility or novelty of the present invention, the braking system (360, 325, 363, 370, 351) can be completely omitted, which would entail substituting a cable or linkage for the braking springs attached to the rear end of the rudder bell crank, and elimination of the tension arms, brake calipers, brake actuator and brake lever.

Steering System

Figure 6A:
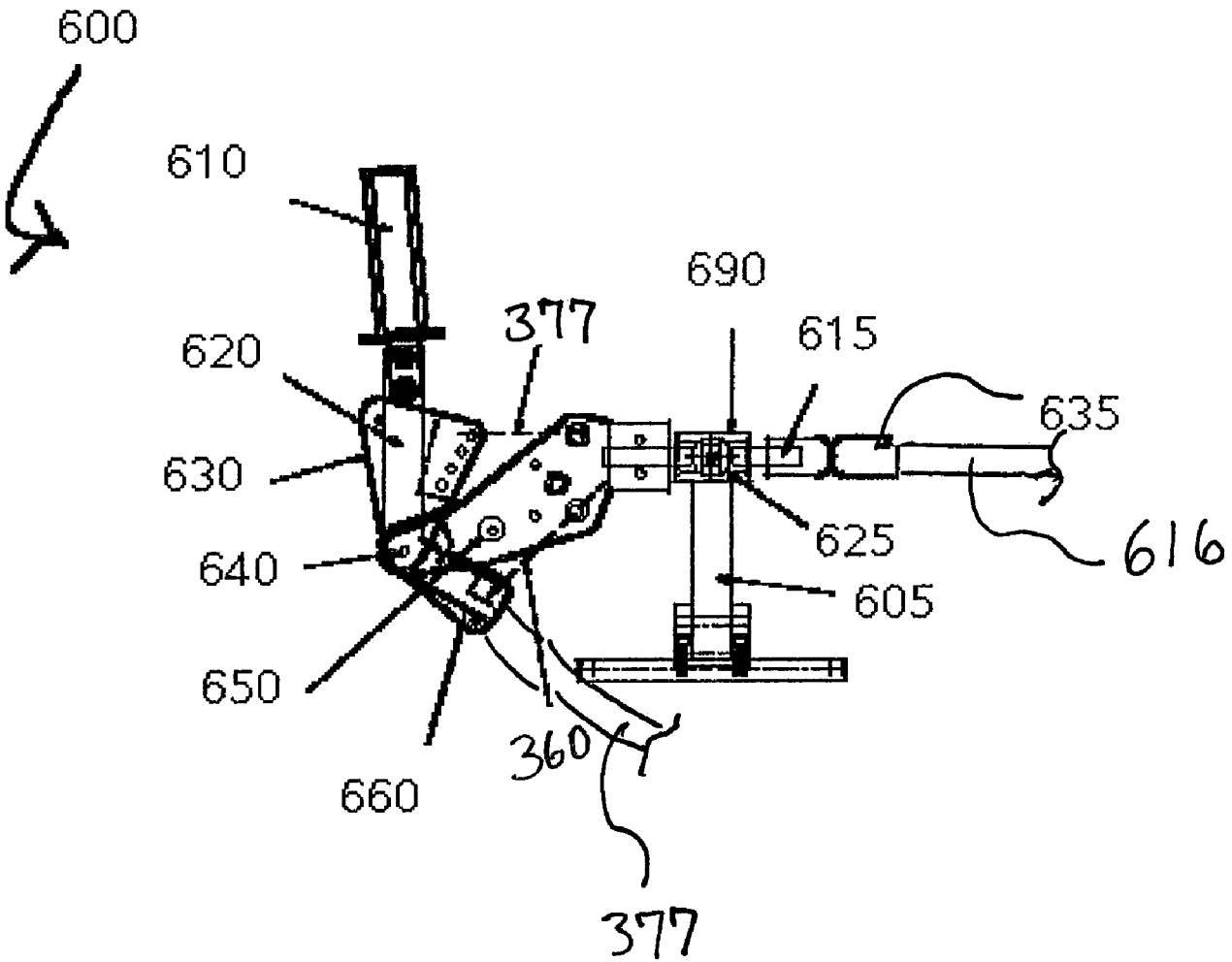
FIG. 6 is an elevation of the control handle assembly for maneuvering the boat.
Figure 6B:
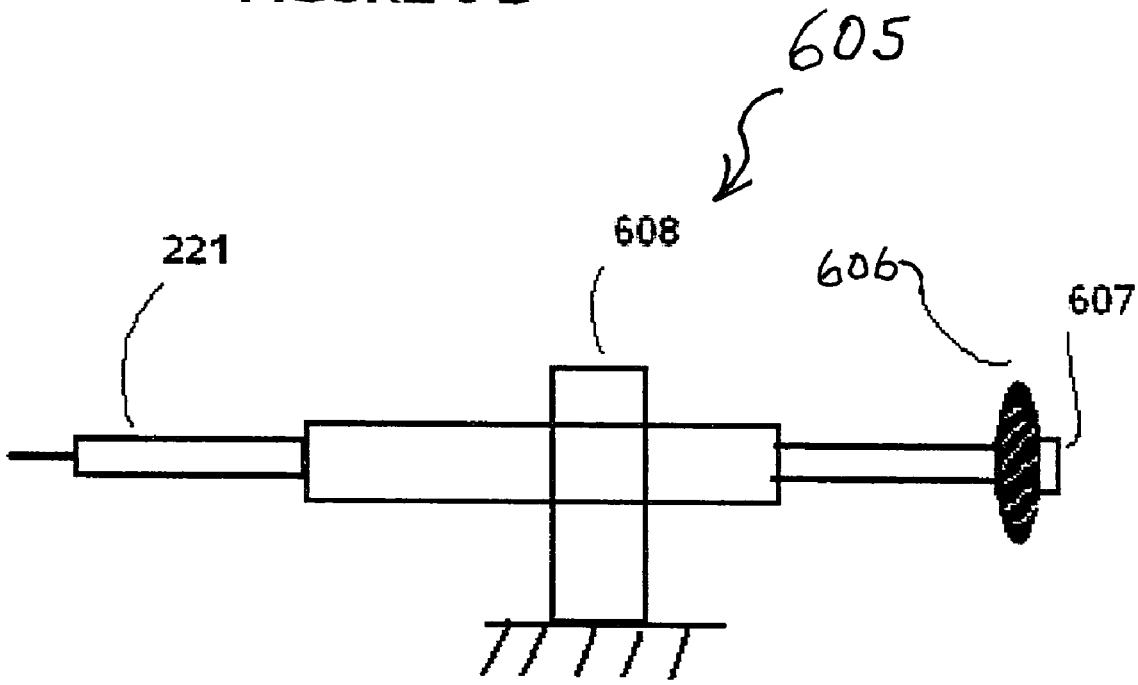

Rotating the control handle 610 in FIG. 6A side-to-side in the +/−x-direction causes the steering wheel 375 to rotate, either by direct mechanical connection or via a remote rotary servo-actuator. The steering assembly may or may not incorporate flexible shaft couplings (361, 635) for alignment purposes. Rotary actuators may include electrohydraulic actuators. The steering shaft 615 may be locked at any steering angle. In the prototype, steering angle may be locked by means of a friction clamp 625. The steering shaft assembly (615, 635, 615, and 361) causes rotation of a steering wheel 375 located at the boat centerline between the bell cranks 365 of the two rudder fins 310. The steering wheel 375 comprises a circular sheave or drum, around which the steering cable 362 is wrapped and secured to prevent slippage. The outside diameter of the steering wheel 375, upon which the steering cable 362 bears, is a body of rotation about reference axis 376 that may or may not be uniformly cylindrical in the +/−y-axis direction, though of constant radius at each y-location.

The outside diameter of the steering wheel 375 may be a body of rotation with u-shaped or v-shaped concave profile in the +/−y-axis direction. Since the steering cable 362 is under tension, this feature provides automatic centering of the steering cable 362 on the steering wheel 375. As the steering wheel 375 rotates, an equal amount of steering cable 362 is paid out to one tension arm 370, and taken in from the opposite tension arm 370, thereby maintaining a parallel relationship between fins 310. The steering cable 362 is attached to the tension arms 370, which are mounted in rotary attachment about reference axis 373 on each bell crank 365. Further, the connection is spring loaded by spring 353 via connecting pin 366. Connecting pin 366 extends upward from the aft most end of rudder bell crank 365 such that spring 353 extends to connecting pin 372 located at the outboard edge of tension arm 370. Tension arm 370 is connected to bell crank 365 through reference axis 373 to maintain tension in the steering cable at all times, such as during braking. Thus movement of steering cable 362 initially causes a corresponding rotary motion of tension arm 370 and thus rudder bell crank 365 connected to rudder fin 310 via a limiting stop pin 374 that extends upward from the face of rudder bell crank 365 when fully engaged in the notch formed inboard side of tension arm 370. Both tension arms 370 are normally held against their respective stop pins 374 due to the moment applied by the braking springs 352 connecting the rear ends of the two rudder bell cranks 365.

Rudder Fin Retraction System

The maneuvering system of FIG. 2 incorporates a mechanism to retract the rudder fin(s) from the water on contact with an obstacle, thus facilitating beaching, clearance of debris or land transport. Alternatively, rotating the control handle 610 of FIG. 6 forward about the x-axis causes retraction lever 630 to pivot forward, in turn causing linear actuator or cable 377 to retract, thereby causing the rudder fins 310 to retract from the water. In the prototype, the linear actuator is a retraction cable 377, which is of the tension-only bicycle type. Retraction of the primary rudder fin retraction cable or actuator 377 causes both rudder fins 310 to simultaneously rotate about their respective x-axis at their support hinges 313, out of their normal immersed position. The primary rudder fin retraction cable or actuator 360 is connected to a pair of caliper arms 320, one end of each arm being fixed and the other end connected to a secondary retraction cable 372 attached to the aft end of a bell crank 378 on each fin support clamp 316. During fin retraction, the fins rotate in the vertical y–z-plane about the fin support hinge joint 313. The secondary retraction cables 372 are routed via idler pulleys 330 mounted on an adjustable support 350 for alignment purposes, to minimize turning moments about reference axis 371 during retraction. As the primary rudder fin retraction actuator 377 is retracted, both caliper arms 320 are caused to pivot about their fixed end, thereby causing simultaneous retraction of the secondary retraction cables 372. The role of the retraction caliper arms is to two-fold; to allow a single retraction actuator 377 to simultaneously retract two rudder fins 310, and to prevent steering and braking motions from being restrained by the retraction system during normal maneuvering (i.e. decoupling of control actions). The rudder fin retraction angle is fully controllable by the operator from zero to 90 degrees about the x-axis. Upon release of the control handle 610, the rudder fins return to their normal immersed position by means of gravity and springs 379 located at the x-axis of rotation of each fin support hinge 313.

Propulsion Fin Retraction System

The maneuvering system in a more preferred embodiment incorporates a mechanism to retract the propulsion fin from the water to facilitate beaching, clearance of debris or land transport. The tail arm 220 can be raised and lowered about the pylon-clevis joint x'-axis by means of a linear actuator connected to the clevis 223 at some radius from the pylon-clevis joint. The fixed end of the retraction actuator is connected to the pylon 230. The linear actuator causes the tail arm and main propulsion fin to rotate vertically about the x-axis at the pylon-clevis joint, out of its normal operating position. In the prototype, the main fin retraction actuator comprises a cable, which is connected to the larger radius of an actuating lever that pivots about the pylon-clevis adjustment shaft; the forward movement of said cable will cause rotation of said lever about said shaft. Said lever is also connected at a smaller radius from said shaft to the forward extension of the clevis via an adjustable length linkage 232, thereby multiplying the force in the main fin retraction cable by the ratio of radii. The cable force required to raise the tail arm is thereby reduced by the ratio of radii of the actuating lever, and/or by the use of lightweight materials for the tail arm boom and main fin assembly. Normal operating angle of the tail arm about the pylon-clevis joint x'-axis is set by adjusting the length of the adjustable length linkage 232 between the actuating lever and forward extension of the clevis. The adjustable length linkage may be disconnected from the forward clevis extension by means of a quick release pin or other device, which allows rotation of the tail arm assembly up to 220 degrees about the pylon-clevis x'-axis thereby facilitating onboard stowage of tail arm. The tail arm angle about the pylon-clevis x'-axis is thereby controllable by the operator from about −15 to +20 degrees from the horizontal about the x'-axis. Tail arm and actuating lever automatically returns by gravity and locks into the normal operating position upon releasing the retraction cable. The main fin retraction actuator may be locked to hold the tail arm and fin in a fully or partially retracted position. Instead of a single cable, the tail arm can be raised or lowered by cable and pulleys, or a hydraulic or pneumatic actuator in lieu of the actuating lever, linkage and cable. Alternatively, without jeopardizing the novelty or utility of the present invention, the main fin retraction system can be eliminated, requiring the operator to adjust propulsion fin immersion depth by adjusting an adjustable linkage connecting the forward extension of the clevis to the pylon-clevis adjustment shaft, while retaining the ability to stow the tail arm assembly on board during transport or beaching by means of the quick release connection between said linkage and clevis extension.

Maneuvering, Braking and Fin Retraction Control Handle System

The maneuvering system in a preferred embodiment incorporates a control system 600 to perform steering, braking and rudder fin retraction via a single control handle 610 illustrated in the elevation in FIG. 6. The control handle 610 may be located to the port or starboard side of the operator. Steering is proportionally applied by rotating the control handle from its zero vertical position up to +/−90 degrees about its y-axis of rotation to rotate steering shaft 615, which is in rotary coupling to steering wheel 375 in FIG. 4. Braking is proportionally applied by rotating the control handle 610 aftwards from its zero vertical position to up to −45 degrees about its x-axis of rotation. Rudder fin retraction is proportionally applied by rotating the control handle 610 forward from its zero vertical position to up to +90 degrees about its x-axis of rotation. A mechanical detent, latch or other device, such as the up-lock pin 650 for retaining actuating lever 620 in FIG. 6, to hold the rudder fins 310 in the fully retracted position, which may be a convenience for beaching and/or transport. Braking and retraction functions are decoupled at the control handle by via a separate braking lever arm 660 and retraction lever arm 630 described with respect to FIG. 4. Only the respective braking or retraction lever arm can move in tandem with the control handle 610 when the control handle moves aft or forward, respectively, from the vertical neutral position as primary retraction cable 377 or primary braking cable 360 are alternatively engaged by movement of actuator lever 620 via either retraction lever 630, for cable 377, or braking lever 660 for cable 360. A friction type clamp is provided on the y-axis steering shaft to hold any selected steering angle as may be chosen by the operator. The control handle 610 may be equipped with an optional articulated handle which can be pivoted +/−20 degrees from the vertical position about it's own x-axis and then locked into the most comfortable and convenient position for the operator. The control handle neutral steering position may be adjusted via a friction clamp 625 between the control handle mechanism and the y-axis steering shaft 615. The control handle may alternatively be supplemented or replaced by rotary and/or linear servoactuators as known in the art to perform all maneuvering functions under command of the microprocessor based control system. Alternatively, the entire control handle assembly may be oriented such that the steering action is achieved by moving the handle side to side in the horizontal plane as with a conventional tiller.

Alternatively, rudder fin and propulsion fin retraction may be accomplished by a separate lever or levers from the steering control handle. Furthermore, remote fin retraction functionality may be completely eliminated without jeopardizing the novelty or utility of the present invention. In the preferred embodiment, shown in FIG. 1, deploys a single rudder fin 310.

Vortex Turning

Figure 9:
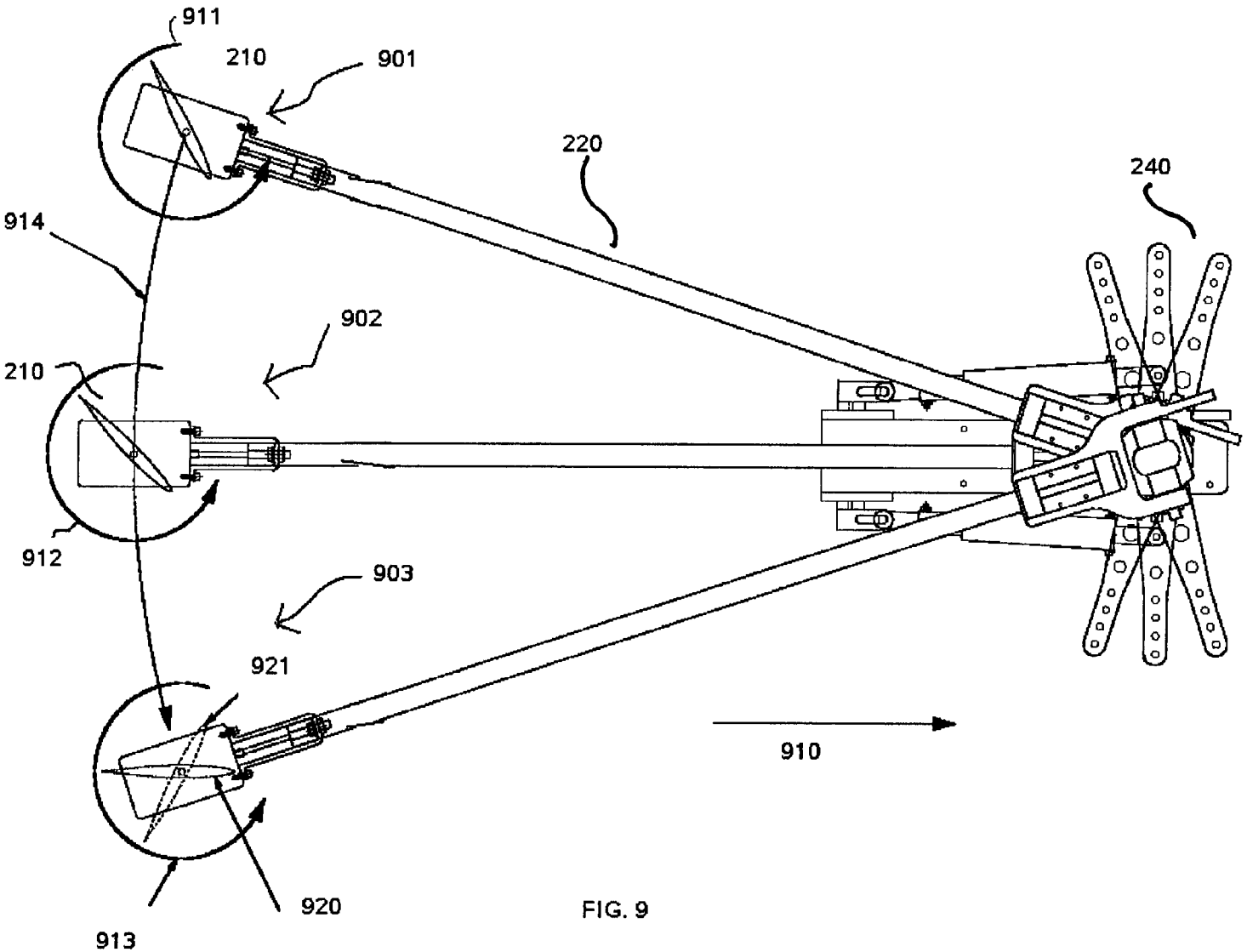
FIG. 9 is a plan view of the propulsion system in the various positions as deployed for vortex turning.

The principles of a highly effective technique for turning the tailboat is illustrated in FIG. 9, and exploits the existence of vortex circulation about the main propulsion fin 210. In practice the operator initiated the turn while traveling in the forward direction with the propulsion fin out of the stall condition. This is confirmed by a "springy" feeling in the foot pedal near the end of each stroke. For purposes of correlating illustration in FIG. 9 we refer to the right foot pedal. At any point during the right pedal stroke, the operator should slow or stop pedaling while applying enough force to hold the right foot pedal in or near that position. Within a few seconds, the operator will feel the right foot pedal push back somewhat harder against the bottom of his foot. The operator should apply just enough force to balance this additional pedal force. So long as the driver feels this additional pedal force acting against his foot, the propulsion fin is in position as a rudder thereby causing he boat to turn to the right. Turning angle is significantly amplified by applying right rudder in a coordinated manner upon the appearance of increased pedal pressure acting on the right foot. The turn is thusly "carved" by coordinated application of rudder and foot pedal position.

Upon the bow reaching the desired direction, the rudder should be returned to the neutral position and pedaling resumed. Turns of 45–60 degrees are routinely accomplished in a single attempt, and up to 90 degrees if conditions are right. Turning angle increases with increasing boat speed at the entry of the turn. The above sequence can be repeated as many times as necessary to turn the required amount.

The movement of propulsion fin 210 during the steering movement is illustrated by the plan view of FIG. 9. When fin 21 moves from left to right, a vortex circulation pattern will be created in the counterclockwise direction about the airfoil profile of the fin (clockwise for foil moving from right to left). The vortex circulation pattern is continuously shed from the tip of the foil. It is this same aerodynamic phenomena that produces the commonly observed wing-tip vortices when large airplanes land or takeoff.

Upon abrupt cessation of pedaling, the shed vortex does not instantaneously disappear, but instead remains attached to and applies a counterclockwise moment about the foil (during left to right foil motion). If the foil is allowed to pivot about an axis sufficiently close to it's center of pressure, the strength of the applied moment will be sufficient to rotate the foil in the counterclockwise direction, thereby overcoming forces/moments that would otherwise cause the fin to align with the approaching flow streamlines, or "weathervane".

In the case of the tailboat invention, the foil thus freely rotates to and stops at the opposite limit position, thereby generating a lift force causing the boat to turn to the right. The converse holds true for foils traveling from right to left, with the direction of vortex circulation clockwise, and turning force reversed causing a left turn.

Initially, at the beginning of right pedal stroke, propulsion fin 210 is in the position indicated by arrow 901, having generated flow vortex indicated by a vortex flow having streamline that correspond with the arrow 911. In the middle of the right pedal stroke propulsion fin and tailboom have move to the position shown by arrow 902, with associated local vortex having a stream indicated by arrow 912, the fin generating heave velocity shown by arrow 914. At the end of the right stroke propulsion fin 210 is now in the position shown by arrow 903, with associated local vortex having a stream indicated by arrow 913, by holding the pedal steady tailboom remains fixed at the end of the stroke as the vortex 920 now rotates propulsion fin 920 from the initial position 920, shown in solid lines, to the position shown by the broken line 921*b*. Thus fin 210 having pivoted to the opposite limit position determined by the positioning of sliding yoke 281, holding the pedal in this position, give or take several degrees, causes the boat to turn to the right. The operator may need to allow the foot pedal to move fore or aft during the turn to sustain maximum rudder effect.

Figure 10:
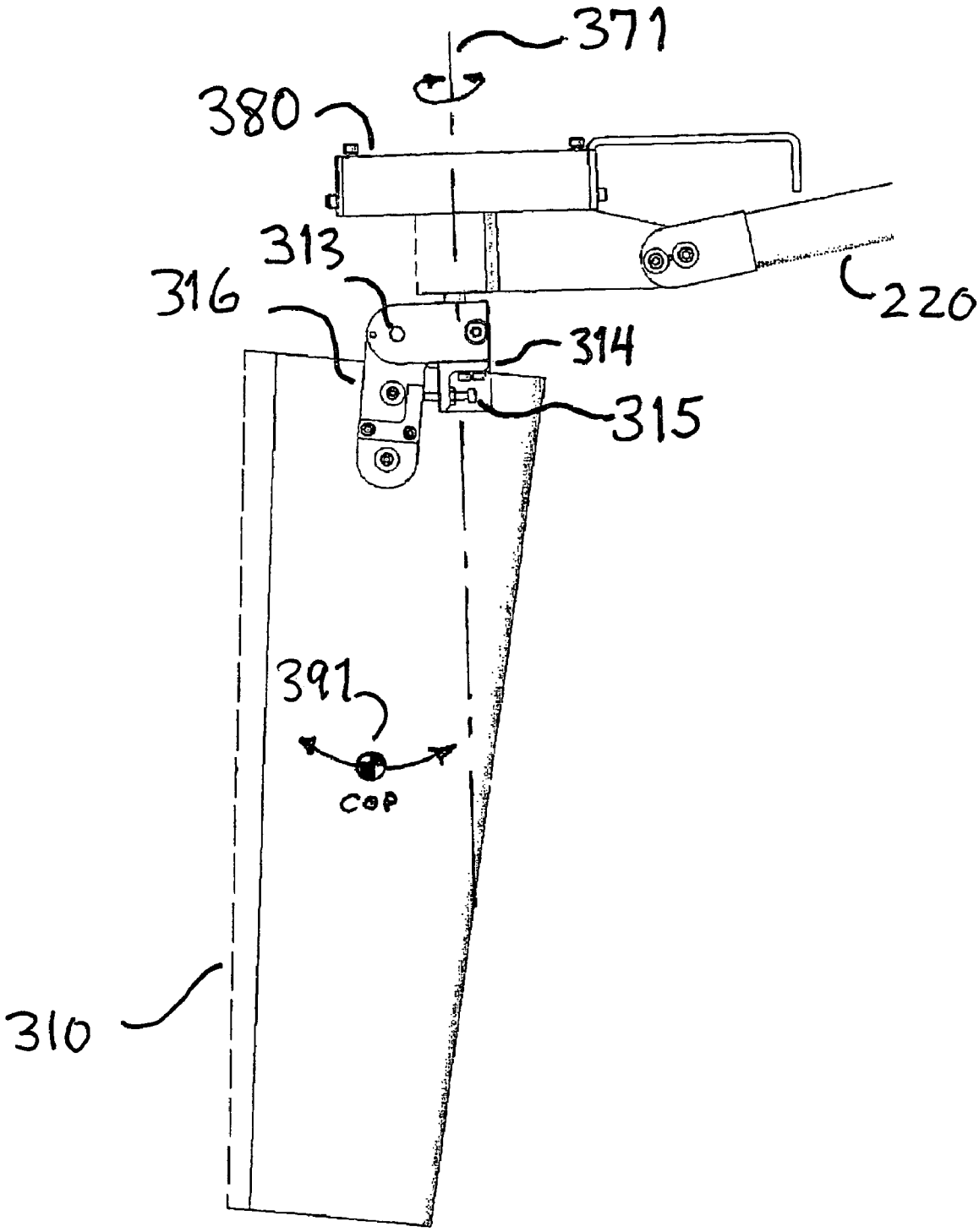
FIG. 10 is an elevation of an assembly for adjusting the displacement of center of pressure of the pivot fin for optimum hydraulic balance.

As the vortex shape and force is determined in part by the configuration and placement of propulsion fin 910, it would be desirable to predict the characteristics of the unsteady wake vortices about the partially immersed hydrofoil surface associated with fin 210. However, as the 3-dimensional flow pattern is highly complex and turbulent in nature, and does not readily lend itself to mathematical analysis using even the most advanced computational methods, we cannot at this time provide a quantitative analysis of this phenomena to teach optimal fin design. Notwithstanding this limitation, an infinite variety of fin shapes and sizes may be coupled to the tailboom and transmission in a manner that is optimum for turning with that fin. Accordingly, in a more preferred embodiment illustrated in FIG. 10, an apparatus and method are provided to physically adjust the pivoting axis for propulsion fin to optimize the hydraulic balance for vortex assisted turning for a wide variety of fin designs. FIG. 10 is an elevation of an assembly for adjusting the displacement of center of pressure of the pivot fin for optimum hydraulic balance. The nominal center of pressure (COP) 391, currently indicated as being disposed aftward of rotation axis 371, is a characteristic of the fin shape as well as instantaneous velocity and angle of attack. Fin support hinges 313 includes a downward extending L bracket 314, disposed forward of fin support clamp 316. Setscrew 315 is threaded into the downward extending portion of L bracket 314. The displacement of setscrew 315 urges fin support clamp 316 to rotate about support hinge 313, adjusting the vertical displacement of the COP from axis 371.

The method of vortex-assisted turning may be of beneficial use in other surface or subsurface vessel designs employing oscillating foils as known in the art. For example, this method may be also employed in autonomous swimming vehicles (ASV's). However, this method is not applicable to oscillating foil systems where the propulsion fin is not allowed to pivot freely, but is controlled to maintain a particular phase relationship with heave amplitude and/or phase, according to U.S. Pat. No. 5,401,196 to Triantafyllou, which is incorporated herein by reference.

Operator Seat Assembly

The preferred embodiment for human powered applications employs a recumbent-type seat design as shown in FIG. 1. This seat 140 places the operators back at an approximately +45 to +60 degree incline to the horizontal. The seat is preferably mounted upon slideably adjustable supports allowing movement forward and aft along the y-axis for operator comfort and fit. The seat supports also allows the seat to be pivoted about the x-axis to adjust the seat's angle of incline. The seat back is supported by an adjustable bracket 141, which can be used to hold the seatback in any angular position about the x-axis between 40 and 90 degrees from horizontal. Other seat designs and types as known in the art may also be usefully employed.

Propulsion Pedal System

For human-powered applications, two bicycle-type foot pedals mounted on pivoting crank arms 130 are provided forward of the operators seat, as shown in FIG. 1. Each crank arm 130 is connected to a drive cable 110, the aft end of the cables being connected to the port and starboard pylon crank arms 240. The bottom end of each pedal crank arm is supported by a detachable and adjustably mounted bearing housing comprising a shaft oriented in the x-direction, and rolling element bearings, though plain bearing may also suffice. In the prototype, approximately 14 inches of leg extension amplitude in the +/−y-direction are provided by the pedal cranks. The drive cables are attached to each pedal crank via a dedicated adjustable turnbuckle. The "at rest", or pedal zero, position about the x-axis is set by adjusting one or both turnbuckles, or by adjusting the forward and aft position of the bearing housings. Each pedal crank is designed to allow cable attachment at a variety of radii between 30% and 70% of the overall crank radius. The primary method of establishing maximum heave amplitude is by selection the appropriate drive cable attachment radius on the pedal cranks and/or pylon crank arms. The foot pedals are attached to the inboard sides of the upper end of each pedal crank arm. Sufficient side clearance should be provided to avoid interference between the outside of the foot/leg and the pedal crank. A tensioning cable 120 connects both pedal cranks, and is routed via a turning block or pulley125 mounted ahead of the pedal crank arms. At least one turning block or pulley is required. A single turning block would be located on the boats y-axis centerline. An alternative means to maintain tension in the drive cables is to hold the pedal cranks forward via springs in lieu of a tensioning cable, the fixed end of the springs being attached to a suitable location on the boat.

Use of the tensioning cable and pulley allows the driver to both push and pull the pedals with each foot for improved performance, via a toe clip or strap, as known in the art.

The tensioning cable 120 preferably incorporates a turnbuckle and an optional spring. Tension is thereby maintained in the drive cables at all times by applying appropriate tension via the tensioning turnbuckle.

Optional Additional Features

The boat may be equipped with a permanent, removable or retractable keel or leeboard, such as leeboard 150 shown in FIG. 1B, keel or leeboards being known in the art for improved turning, reduced sideslip during turns, roll stability, tracking during turns or crosswinds, and directional stability. The keel or leeboard 150 is preferably mounted approximately amidships along the y-axis near the boat center of gravity or lateral center of resistance, at either side or middle of the boat, as known in the art. The leeboard or keel may be supported by a vertical shaft allowing alignment with the hull centerline. The leeboard support shaft may optionally be fitted with tiller to assist in steering, either manually or via mechanical linkage to the steering shaft 615.

The propulsion and maneuvering system assemblies may be combined into a single package, or the assemblies may be packaged together in any combination or mounted separately. The various assemblies and components may be manufactured by any method or of any suitable structural material known in the art.

The boat may be equipped with a sail, which may be mounted on a permanent or stowable mast. The boat may be equipped with single or double outriggers. The boat may be equipped with a photoelectric array, electric energy storage/control system, and electric drive motor connected to the pylon crank arm.

The propulsion system may be powered by an internal combustion engine or electric motor, with required ancillary systems as known in the art, connected to the pylon crank arm in lieu of or in addition to the system of pedals and drive cables.

The boat may be equipped with microprocessor based control system for controlling throttle yoke position and/or electric drive motor power and speed. The microprocessor control system may include a human-machine interface (HMI) to provide indication of boat operating parameters and system status/alarms to the operator. The boat may incorporate a swivel type seat and dual sets of pedals, allowing the operator to pedal the boat facing the fore or aft position.

The boat may be designed to carry more than one passenger, with ganged pedal sets for some or all passengers. The boat may be equipped with optional arm levers connected to the drive cables, to permit power input from arms and/or legs. The boat may be alternatively equipped with foot pedals mounted on moveable, rolling, or linear bearings, instead of the pivoting pedal cranks in the preferred embodiment.

Hull System

The aforementioned systems may be installed on any suitable marine vessel of single hull, multi-hull or hydrofoil design. The hulls may be designed with or without hard chines or other hydrodynamic features to promote planing. In yet other aspects of the invention the hull and propulsion system, that is human or machine powered, and tail boom pivot actuator may be selected in accordance with the end user requirements incorporated all or selected novel and preferred embodiments described herein.

Multiple sets of the aforementioned propulsion-related systems may be installed in parallel configuration on a single marine vessel, powered by a single driver or prime mover, or by multiple drivers or prime movers. The throttle control for each propulsion system may be operated in unison with or independently from the other throttle controls, thereby allowing said multiple parallel propulsion systems to simultaneously operate in forward thrust, mixed forward and reverse thrust, or reverse thrust for the purpose of vessel steering and maneuvering.

Figure 8C:
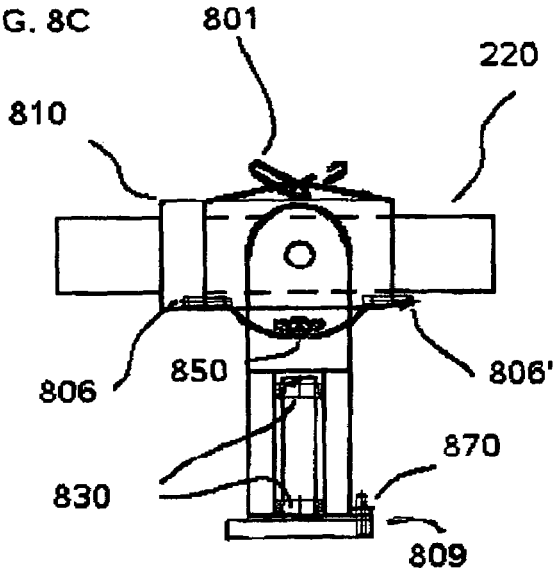
FIG. 8C illustrates further details of the gimbal support of FIGS. 8A and 8B, including a plan view, FIG. 8D, of the corresponding components.
Figure 8D:
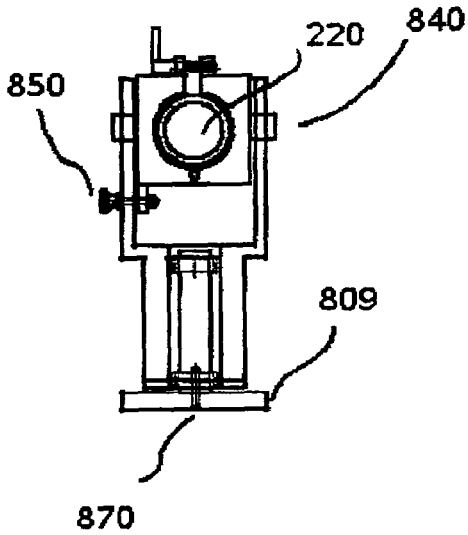
FIGS. 8A and 8B illustrate in elevation alternative configurations of a combination tiller and sculling propulsion device.
FIG. 8E is a plan view of the boat mounting base of the gimbal support.
Figure 8E:
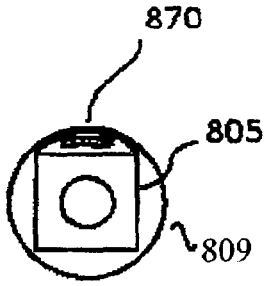

In yet another embodiment, illustrated in FIG. 8, the tail boom assembly 800 might be designed to either slide inboard to function as a conventional tiller (FIG. 8A), for a sail or powerboat, or slide outboard to allow hand power propulsion (FIG. 8B), or "sculling", in slack wind conditions, such as when the sail is raised or lowered. Converting the tiller 800, in FIG. 8A, to the propulsion tailfin in FIG. 8B, facilitates maneuvering the vessel forward or backward in close quarters while docking or getting underway. The tailarm boom 220 is mounted on a gimbal support assembly 805 having boat mounting base 809 shown in further detail in the FIG. 8C, affixed to the stern or transom of the boat. Two stop collars 810 and 810' are mounted on the boom 220 to establish the steering and sculling operating positions, which are located aft and forward on the boom, respectively. The boom position fore and aft is adjusted by releasing the boom locking clamp 801 and then sliding the boom to the respective steering or sculling stop collar 810 or 810'. As shown in the orthogonal elevations FIGS. 8C and 8D of the gimbal support 805 illustrated in plan view in FIG. 8D) may be fitted with two anti-rotation pins fore 806 and aft 806' which fit into mating holes on the fore and aft stop collars to help maintain fin vertical position with respect to the water. Once the boom is in the desired position, the locking clamp 801 is tightened. A handgrip 880 is attached to the inboard end of the tailarm boom 220, which also provides fine adjustment control over the fin pivot angle by rotating the handgrip about the centerline of the boom. The handgrip may be equipped with a coarse override button 890 which can be depressed to allow sliding of the handgrip 880 fore and aft along the boom 220, say, for shifting from forward to reverse thrust. Both the handgrip 880 and coarse override button 890 are connected to a push-pull control cable 885 or other linear actuator, which is in turn connected to the transmission 280 for controlling pivot angle and thrust direction of the fin. The gimbal support assembly 805 incorporates at least one bearing 830 to allow the gimbal housing to rotate about the vertical centerline of the support assembly. The support assembly 805 may incorporate a hinge 840 and elevation adjustment lock 850 to allow locking the boom at a desired angle from the horizontal position. The support assembly 805 may incorporate a slewing limit stop device 870, to limit the maximum sweep or slewing angle about the vertical centerline of the support assembly.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

What is claimed is:

1. A marine propulsion system comprising, a) a pivoting fin, b) a reciprocating arm extending aftward from the vessel, the aft portion of said arm providing a rotary support for said pivoting fin, and c) a transmission for modulating the pivoting movement of said pivoting fins provides fully adjustable forward and reverse thrust via a single linear actuator coupled to single throttle control.

2. A marine propulsion system according to claim 1 wherein the pivoting fin is a laminar flow airfoil.

3. A marine propulsion system comprising, a) a pivoting fin, b) a reciprocating arm rotating about a first axis, the first axis disposed so as to extend aftward from a vessel being propelled, the aft portion of said arm that is distal from the location of the first axis providing a support for the rotary motion of said pivoting fin at a second axis, c) a crank arm connected transverse to said arm at the first axis thereof, d) a power source coupled to drive the reciprocal rotary motion of said a reciprocating arm about the first axis, e) one or more energy storage devices coupled to said crank arm such that at least a portion of the energy from said power source is stored in the energy storage device for some portion of the movement of said reciprocating arm before being transferred to said reciprocating arm.

4. A marine propulsion system according to claim 3 further comprising at least one cable for coupling said power source to said crank arm wherein the movement of said crank arm drives said reciprocating arm.

5. A marine propulsion system according to claim 1 Wherein said single linear actuator is single flexible control cable terminated on one end at the transmission and at the other end at the control knob.

6. A vessel comprising:

a) a marine propulsion connected to the aft portion of said vessel, said propulsion system comprising;

i) a pivoting fin, ii) a rotary support for said pivoting fin, iii) a reciprocating arm rotating about a first axis, the first axis disposed so as to extend aftward from the vessel, said rotary support being disposed for rotary motion about a second axis, the second axis being on the aft portion of said arm that is distal from the location of the first axis, iv) a power source coupled to drive the reciprocal rotary motion of said a reciprocating arm about the first axis; and b) a steering system connected to said vessel and comprising;

i) one or more pectoral fins disposed in the water forward of said pivoting fin for rotation about a third axis, the third axis being substantially parallel to each of the first and second axis, ii) a joystick coupled to said pectoral fin for modulating the orientation thereof with respect to said third axis.

7. A vessel according to claim 6 wherein said pivoting fin is a laminar flow airfoil.

8. A vessel according claim 6 wherein the propulsion system comprises at least one pair of foot pedals and said footpedals are coupled to said reciprocating arm via cables.

9. A vessel according claim 6 further comprising means for attaching handgrips to drive said power source.

10. A marine propulsion system according to claim 6 further comprising means for allowing arms to drive said power source.

11. A marine propulsion system according to claim 6 and further comprising means for foul resistant and removable fins.

12. A marine steering and propulsion system comprising:

a) a first armature having a first rotary pivot for attachment toward the aft portion of a vessel, b) A second armature attached to the aft portion of said first armature and being capable of extending in the aftward direction therefrom, c) a fin attached to the aftward portion of said second armature, d) wherein the aft portion of said second armature provides a second rotary support allowing said fin to pivot when said second armature is extended, wherein said second rotary support is fixed when said second armature is not extended.

13. A marine steering and propulsion system comprising:

a) a first armature having a first rotary pivot for attachment toward the aft portion of a vessel, b) A second armature attached to the aft portion of said first armature and being capable of extending in the aftward direction therefrom, c) a fin attached to the aftward portion of said second armature, d) wherein the aft portion of said second armature provides a second rotary support allowing said fin to pivot when said second armature is extended wherein said second armature extends by telescoping aftward from said first armature.

14. A marine vessel having a a) marine propulsion system attached toward the aftward portion of said vessel, said propulsion system comprising, i) a pivoting fin, ii) a reciprocating arm for extending aftward from the vessel, the aft portion of said arm providing a rotary support for said pivoting fin, iii) a transmission for optionally modifying the pivot movement of said fin with respect to the direction of motion of said reciprocating arm so as enable either the stationary, forward or reverse movement of the vessel while said arm is in motion, b) a seat attached to said vessel forward of said propulsion system for disposing a person providing the human energy to power said propulsion system in a recumbent sitting position.

15. A marine vessel according to claim 14 further comprising means for the person in the recumbent seating position to power said propulsion system by leg movement.

16. A marine vessel according to claim 14 further comprising means for the person in the recumbent seating position to power said propulsion system by arm movement.

* * * * *